US010060122B2

(12) United States Patent
Robinson

(10) Patent No.: US 10,060,122 B2
(45) **Date of Patent: *Aug. 28, 2018**

(54) EXPANSION JOINT SEAL SYSTEM

(71) Applicant: Schul International Company, LLC, Pelham, NH (US)

(72) Inventor: Steven R. Robinson, Windham, NH (US)

(73) Assignee: Schul International Company, LLC, Pelham, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/884,553

(22) Filed: Jan. 31, 2018

(65) Prior Publication Data

US 2018/0148922 A1 May 31, 2018

Related U.S. Application Data

(63) Continuation-in-part of application No. 15/681,500, filed on Aug. 21, 2017, now Pat. No. 9,982,429, which is a continuation of application No. PCT/US2016/019059, filed on Feb. 23, 2016, which is a continuation of application No. 14/643,031, filed on Mar. 10, 2015, now Pat. No. 9,206,596.

(51) Int. Cl.
*E04B 1/68* (2006.01)
*E04B 1/94* (2006.01)

(52) U.S. Cl.
CPC ..... *E04B 1/6812* (2013.01); *E04B 1/948* (2013.01); *E04B 2001/6818* (2013.01)

(58) Field of Classification Search
CPC ..... E04B 1/948; E04B 1/6812; E04B 1/6813; E04B 1/6815; E04B 1/68; E04B 2/7411; E04B 1/94; E04B 1/6804; E04B 1/6818
See application file for complete search history.

(56) References Cited

U.S. PATENT DOCUMENTS

| | | | |
|---|---|---|---|
| 945,914 | A | 4/1909 | Colwell |
| 1,371,727 | A | 3/1921 | Blickle |
| 2,544,532 | A | 3/1951 | Hill |
| 2,995,056 | A | 10/1960 | Knox |

(Continued)

FOREIGN PATENT DOCUMENTS

| | | | |
|---|---|---|---|
| CA | 1280007 | | 2/1991 |
| CA | 1334268 | | 2/1995 |
| CA | 2296779 | | 11/2006 |
| DE | 4436280 | A1 | 2/1996 |
| DE | 102005054375 | A1 | 5/2007 |
| EP | 0942107 | A2 | 9/1999 |
| EP | 1118715 | B1 | 10/2004 |
| EP | 1540220 | | 3/2006 |
| EP | 1983119 | A1 | 4/2007 |

(Continued)

OTHER PUBLICATIONS

Advanced Urethane Technologies; Polyurethane Foam Specification Sheet; 1 page; Apr. 1, 2007.

(Continued)

*Primary Examiner* — Beth A Stephan
(74) *Attorney, Agent, or Firm* — Crain, Caton & James, P.C.; James E. Hudson, III

(57) ABSTRACT

An expansion joint seal system which includes intumescent to protect uncoated edges of substrates. A fire rated compressed expansion joint sealant is provided having an intumescent proximate, but below the water-resistant top of the fire-retardant foam, so that when exposed to fire, the intumescent expands to protect the exposed vertical surface of the adjacent concrete substrate. The end of the concrete is therefore protected in a manner which does not require joint overlap between the horizontal fire resistant coating and the compressible sealant.

8 Claims, 4 Drawing Sheets

(56) References Cited

U.S. PATENT DOCUMENTS

| | | | |
|---|---|---|---|
| 3,262,894 | A | 7/1966 | Green |
| 3,334,557 | A | 8/1967 | Fitzgibbon |
| 3,449,879 | A | 6/1969 | Bloom |
| 3,455,850 | A | 7/1969 | Saunders |
| 3,492,250 | A | 1/1970 | Deyrup |
| 3,527,009 | A | 9/1970 | Nyquist |
| 3,712,188 | A | 1/1973 | Worson |
| 3,772,220 | A | 11/1973 | Porter et al. |
| 3,827,204 | A | 8/1974 | Walters |
| 3,883,475 | A | 5/1975 | Racky et al. |
| 4,018,539 | A | 4/1977 | Puccio |
| 4,058,947 | A | 11/1977 | Earle et al. |
| 4,134,875 | A | 1/1979 | Tapia |
| 4,181,711 | A | 1/1980 | Ohashi et al. |
| 4,224,374 | A | 9/1980 | Priest |
| 4,237,182 | A | 12/1980 | Fulmer et al. |
| 4,260,688 | A | 4/1981 | Simon |
| 4,288,559 | A | 9/1981 | Illger |
| 4,374,207 | A | 2/1983 | Stone et al. |
| 4,401,716 | A | 8/1983 | Tschudin-Mahrer |
| 4,455,396 | A | 6/1984 | Al-Tabaqchall et al. |
| 4,565,550 | A | 1/1986 | Dorer, Jr. et al. |
| 4,566,242 | A | 1/1986 | Dunsworth |
| 4,654,550 | A | 3/1987 | Lowther et al. |
| 4,767,655 | A | 8/1988 | Tschudin-Mahrer |
| 4,839,223 | A | 6/1989 | Tschudin-Mahrer |
| 4,922,676 | A | 5/1990 | Sproken |
| 4,992,481 | A | 2/1991 | von Bonin et al. |
| 5,000,813 | A | 3/1991 | Hill |
| 5,006,564 | A | 4/1991 | Noonenbruch et al. |
| 5,007,765 | A | 4/1991 | Deitlein et al. |
| 5,130,176 | A | 7/1992 | Baerveldt |
| 5,173,515 | A | 12/1992 | von Bonin |
| 5,253,459 | A | 10/1993 | Parinas et al. |
| 5,327,693 | A | 7/1994 | Schmid |
| 5,335,466 | A | 8/1994 | Langohr |
| 5,686,174 | A | 7/1997 | Irrgeher |
| 5,744,199 | A | 4/1998 | Joffre et al. |
| 5,765,332 | A | 6/1998 | Landin et al. |
| 5,935,695 | A | 8/1999 | Baerveldt |
| 6,039,503 | A | 3/2000 | Cathey |
| 6,418,688 | B1 | 7/2002 | Jones, Jr. |
| 6,532,708 | B1 | 3/2003 | Baerveldt |
| 6,544,445 | B1 | 4/2003 | Graf et al. |
| 6,666,618 | B1 | 12/2003 | Anaya et al. |
| 6,685,196 | B1 | 2/2004 | Baerveldt |
| 6,698,146 | B2 | 3/2004 | Morgan et al. |
| 6,928,777 | B2 | 8/2005 | Cordts |
| 8,317,444 | B1 | 11/2012 | Hensley |
| 8,341,908 | B1 | 1/2013 | Hensley et al. |
| 8,365,495 | B1 | 2/2013 | Witherspoon |
| 8,590,231 | B2 | 11/2013 | Pilz et al. |
| 8,595,999 | B1 | 12/2013 | Pilz et al. |
| 8,720,138 | B2 | 5/2014 | Hilburn, Jr. |
| 8,739,495 | B1 | 6/2014 | Witherspoon |
| 8,813,449 | B1 | 8/2014 | Hensley et al. |
| 8,813,450 | B1 | 8/2014 | Hensley et al. |
| 8,870,506 | B2 | 10/2014 | Hensley et al. |
| 8,935,897 | B2 | 1/2015 | Shaw |
| 9,045,899 | B2 | 6/2015 | Pilz et al. |
| 9,068,297 | B2 | 6/2015 | Hensley et al. |
| 9,200,437 | B1 | 12/2015 | Hensley et al. |
| 9,206,596 | B1 | 12/2015 | Robinson |
| 9,322,163 | B1 | 4/2016 | Hensley |
| 9,404,581 | B1 | 8/2016 | Robinson |
| 9,528,262 | B2 | 12/2016 | Witherspoon |
| 9,631,362 | B2 | 4/2017 | Hensley et al. |
| 9,637,915 | B1 | 5/2017 | Hensley et al. |
| 9,644,368 | B1 | 5/2017 | Witherspoon |
| 9,670,666 | B1 | 6/2017 | Witherspoon et al. |
| 9,677,299 | B2 | 6/2017 | Whiteley |
| 9,689,157 | B1 | 6/2017 | Hensley et al. |
| 9,689,158 | B1 | 6/2017 | Hensley et al. |
| 9,719,248 | B1 | 8/2017 | Meacham |
| 9,732,853 | B2 | 8/2017 | Kethorn et al. |
| 9,739,049 | B1 | 8/2017 | Robinson |
| 9,739,050 | B1 | 8/2017 | Hensley et al. |
| 9,745,738 | B2 | 8/2017 | Robinson |
| 9,765,486 | B1 | 9/2017 | Robinson |
| 9,803,357 | B1 | 10/2017 | Robinson |
| 9,840,814 | B2 | 12/2017 | Robinson |
| 9,850,662 | B2 | 12/2017 | Hensley |
| 9,856,641 | B2 | 1/2018 | Robinson |
| 9,915,038 | B2 | 3/2018 | Robinson |
| 9,951,515 | B2 | 5/2018 | Robinson |
| 9,963,872 | B2 | 5/2018 | Hensley et al. |
| 9,982,428 | B2 | 5/2018 | Robinson |
| 9,982,429 | B2 | 5/2018 | Robinson |
| 2003/0005657 | A1 | 1/2003 | Visser et al. |
| 2003/0110723 | A1 | 6/2003 | Baerveldt |
| 2004/0035075 | A1 | 2/2004 | Trout |
| 2004/0093815 | A1 | 5/2004 | Cordts |
| 2005/0034389 | A1 | 2/2005 | Boot |
| 2005/0126848 | A1 | 6/2005 | Siavoshai |
| 2006/0053710 | A1 | 3/2006 | Miller et al. |
| 2006/0117692 | A1 | 6/2006 | Trout |
| 2007/0059516 | A1 | 3/2007 | Vincent et al. |
| 2008/0172967 | A1 | 7/2008 | Hilburn |
| 2008/0268231 | A1 | 10/2008 | Deib |
| 2010/0275539 | A1 | 11/2010 | Shaw |
| 2010/0304078 | A1 | 12/2010 | Stol |
| 2012/0022176 | A1 | 1/2012 | Strahl et al. |
| 2012/0023846 | A1 | 2/2012 | Mattox et al. |
| 2012/0117900 | A1 | 5/2012 | Shaw |
| 2013/0055667 | A1 | 3/2013 | Beele |
| 2014/0219719 | A1 | 8/2014 | Hensley et al. |
| 2014/0360118 | A1 | 12/2014 | Hensley et al. |
| 2015/0068139 | A1 | 3/2015 | Witherspoon |
| 2015/0337530 | A1 | 11/2015 | Pilz et al. |
| 2017/0130450 | A1 | 5/2017 | Witherspoon |
| 2017/0159817 | A1 | 6/2017 | Robinson |
| 2017/0191256 | A1 | 7/2017 | Robinson |
| 2017/0226733 | A1 | 8/2017 | Hensley et al. |
| 2017/0241132 | A1 | 8/2017 | Witherspoon |
| 2017/0254027 | A1 | 9/2017 | Robinson |
| 2017/0268222 | A1 | 9/2017 | Witherspoon et al. |
| 2017/0292262 | A1 | 10/2017 | Hensley et al. |
| 2017/0298618 | A1 | 10/2017 | Hensley et al. |
| 2017/0314213 | A1 | 11/2017 | Robinson |
| 2017/0314258 | A1 | 11/2017 | Robinson |
| 2017/0342665 | A1 | 11/2017 | Robinson |
| 2017/0342708 | A1 | 11/2017 | Hensley et al. |
| 2017/0370094 | A1 | 12/2017 | Robinson |
| 2018/0002868 | A1 | 1/2018 | Robinson |
| 2018/0016784 | A1 | 1/2018 | Hensley et al. |
| 2018/0038095 | A1 | 2/2018 | Robinson |
| 2018/0106001 | A1 | 4/2018 | Robinson |
| 2018/0106032 | A1 | 4/2018 | Robinson |
| 2018/0119366 | A1 | 5/2018 | Robinson |
| 2018/0142465 | A1 | 5/2018 | Robinson |
| 2018/0148922 | A1 | 5/2018 | Robinson |

FOREIGN PATENT DOCUMENTS

| | | | |
|---|---|---|---|
| GB | 977929 | | 12/1964 |
| GB | 1359734 | | 7/1974 |
| GB | 1495721 | | 12/1977 |
| GB | 1519795 | | 8/1978 |
| GB | 2251623 | A1 | 7/1992 |
| GB | 2359265 | A1 | 8/2001 |
| WO | 03006109 | | 1/2003 |
| WO | 2003066766 | A1 | 8/2003 |
| WO | 2007023118 | A2 | 3/2007 |
| WO | 2006127533 | A1 | 11/2009 |

OTHER PUBLICATIONS

American Institute of Architects, Masterspec, Feb. 1997.

Bonsignore, P.V.; Alumina Trihydrate as a Flame Retardant for Polyurethane Foams; Journal of Cellular Plastics, 174(4): 220-225; Jul./Aug. 1981; 6 pages.

Bonsignore, P.V.; Flame Retardant Flexible Polyurethane Foam by Post-Treatment with Alumina Trihydrate/latex Binder Dispersion

(56) References Cited

OTHER PUBLICATIONS

Systems;Journal of Cellular Plastics; May-Jun. 1979, pp. 163-179, 17 pages.
Dow Corning USA; Letter of Oct. 4, 1984 to Emseal USA, Inc.; 1 page; Oct. 4, 1984.
Emseal Corporation; Emseal Emseal GreyFlex SpecData; 1984; 4 pages.
Emseal Joint System, Ltd.; 25V; Apr. 1996; 2 pages.
Emseal Joint Systems, Ltd.; Colorseal Tech Data; 2 pages; Feb. 1991.
Emseal Joint System, Ltd.; Colorseal TechData; Jan. 2000.
Emseal Joint Systems, Ltd.; Colorseal in EIFS Application Focus; May 1997; 2 pages.
Emseal Joint Systems, Ltd.; Greyflex Expanding Foam Sealant; Feb. 1992.
Emseal Joint Systems, Ltd.; Greyflex Tech Data; Apr. 1996.
Emseal Joint Systems, Ltd.; The Complete Package for All Joint Requirements; 6 pages; 1988.
Emseal Corporation; Research and Development at Emseal; Jun. 27, 2007; 2 pages.
Envirograf; Product 40: Intumescent-Coated Fireproof Sponge (Patented); Apr. 8, 2007, 2 pages.
Hilti Construction Chemicals, Inc.; CP 604 Flexible Firestop Sealant; 1 page; 2005.
Hilti Construction Chemicals, Inc.; CP 606 Flexible Firestop Sealant; 5 pages; Apr. 25, 2000.
Hilti, Inc.; Firestop Board (CP 675T); 1 page; Apr. 2, 2007 (date shown in Google search: https://www.google.com/search?q=hilti+cp+675&source=Int&tbs=cdr%3A1%2Ccd_min%3A1%2F1%2F1900%2Ccd_max%3A12%2F31%2F2009&tbm).
Hilti Firestop Systems; Untitled; 3 pages; Aug. 2013.
Hilti, Inc; FS 657 Product Information, Material Safety Data Sheet, and UL Certificate of Compliance; 4 pages; Feb. 14, 2006.
Hilti Inc.; Material Data Safety Sheet FS 657 Fire Block; CP 658T Firestop Plug; 2 pages; Mar. 1, 2005.
Illbruck Construction Products; Worldwide solutions to joint-sealing and acoustic problems; Apr. 9, 1998; 77 pages.
Illbruck; Will-Seal Precompressed expanding foam sealants; Sep. 1988; 4 pages.
Illbruck Inc.; Willseal precompressed foam sealants; 1991; 4 pages.
Illbruck/USA; Will-Seal (binder); 39 pages; 1984.
Illbruck Product Data Sheet Compriband MPA; Apr. 2000; 2 pages.
Illbruck Sealant Systems, inc.; Fax-Message of Jan. 30, 2002; Jan. 30, 2002; 14 pages.
Illbruck Sealant Systems, inc.; Fax-Message of Feb. 15, 2002; Feb. 15, 2002; 14 pages.
Iso-Chemie GmbH; Sicherheitsdatenblatt (ISO Flame Kombi F120); Jun. 30, 2004; 3 pages.
IsoChemie; Invoice 135652 to Schul International Co., LLC. for Iso-Bloco 600 and Iso-Flame Kombi F120; Apr. 26, 2007; 3 pages // IsoChemie; Order Confirmation 135652 to Schul International Co., LLC. for Iso-Bloco 600 and Iso-Flame Kombi F120; Apr. 26, 2007; 3 pages // IsoChemie; Correspondence of Jun. 8, 2006 and prior; 13 pages // Schul International Company; Invoice 18925 to P.J., Spillane; Sep. 14, 2007; 6 pages.
Katz, Harry S. and Milewski, John V.; Handbook of Fillers for Plastics; 1987; pp. 292-312.
Polytite Manufacturing Corp.; Spec Section 07920 Polytite Expansion Joint System; 1 page; May 1989.
Sandell Manufacturing Company, Inc.; About Polyseal—procompressed joint sealant—from Sandell Manufacturing; 2 pages; Mar. 15, 1999.
Sandell Manufacturing Company, Inc.; Polyseal Precompressed Joint Sealant; 2 pages; Available by Jan. 31, 2000.
Sandell Manufacturing Company, Inc.; Polytite Sealant & Construction Gasket; 1 page; 1978.
Schul International Co., LLC.; Seismic Sealtite "R"; 2 pages; 2002.
Soudal NV; Soudaband Acryl; Jun. 7, 2005; 4 pages.
Tremco Illbruck; Illbruck illmod Trio; Jun. 2007; 2 pages.
Tremco illbruck Produktion GmbH; Materials Safety Data Sheet (illmod 600); Mar. 2, 2007; 4 pages.
Westinghouse Savanah River Company; Design Proposal for Sealing Gap at Z-Area Saltstone Vault One, Cell A (U); 6 pages; Jul. 26, 1994; Aiken, South Carolina, available at http://pbadupws.nrc.gov/docs/ML0901/ML090120164.pdf, indexed by Google.
Iso Chemie GmbH; Iso-Flame Kombi F120; Jul. 1, 2006; 2 pages.
IsoChemie; Technical Datasheet blocostop F-120; Jul. 26, 2002; 1 page.
Lester Hensley; Where's the Beef in Joint Sealants? Hybrids Hold the Key; Spring 2001; Applicator vol. 23 No. 2; 5 pages (alternative version available at http://www.emseal.com/InTheNews/2001HybridsConstructionCanada.pdf).
MM Systems; ejp Expansion Joints EIF; Nov. 16, 2007; 2 pages.
MM Systems; ejp Expansion Joints; Nov. 16, 2007; 2 pages.
MM Systems; MM ColorJoint/SIF Series; 3 pages; Jan. 14, 2007.
Norton Performance Plastics Corporation; Norseal V740FR; 1996; 2 pages.
PCT/US2005/036849 filed Oct. 4, 2005 by Emseal Corporation; 11 pages; published Mar. 1, 2007 by World Intellectual Property Organization as WO 2007/024246.
Promat; Promaseal FyreStrip Seals for Movement in Joints in Floors/Walls; Feb. 2006; 4 pages.
Promat; Promaseal Guide for linear gap seals and fire stopping systems; 20 pages; Jun. 2008.
Promat; Promaseal IBS Foam Strip Penetration Seals on Floors/Walls; Sep. 2004; 6 pages.
Promat; Promaseal IBS Safety Data Sheet; Jul. 25, 2007; 3 pages.
Salamander Industrial Products Inc.; Blocoband HF; Feb. 15, 1996; 1 page.
Schul International Co. LLC; Color Econoseal Technical Data; Nov. 18, 2005; 2 pages.
Schul International Co. LLC; Sealtite "B" Technical Data; Oct. 28, 2005; 2 pages.
Schul International Co. LLC; Sealtite Airstop AR; Apr. 2004; 1 page.
Schul International Co. LLC; Sealtite Airstop FR; Apr. 2007; 1 page.
Schul International Co. LLC; Sealtite Standard; May 9, 2007; 2 pages.
Schul International Co. LLC; Sealtite Technical Data; Oct. 28, 2005; 2 pages.
Schul International Co. LLC; Sealtite VP (600) Technical Data; 2002.
Schul International Co. LLC; Seismic Sealtite II Technical Data; Sep. 20, 2006; 2 pages.
Schul International Co. LLC; Seismic Sealtite Technical Data; Oct. 28, 2005; 2 pages.
Lee W. Young, Written Opinion of the International Searching Authority, PCT/US06/60096, dated Oct. 23, 2007, 4 pages, USPTO, USA.
Schul International Inc.; Sealtite 50N Technical Data; 2002; 2 pages.
Schul International Inc.; Sealtite 50N Technical Data; Oct. 28, 2005; 2 pages.
Emseal's new Universal-90 expansion joints, Buildingtalk, Mar. 27, 2009, 2 pages, Pro-Talk Ltd.
Schul International Inc.; Sealtite VP; Oct. 28, 2005; 2 pages.
Schul International Inc.; Sealtite; Jul. 25, 2008; 3 pages.
Sealant Waterproofing & Restoration Institute; Sealants: The Professionals' Guide p. 26; 1995; 3 pages.
Stein et al. "Chlorinated Paraffins as Effective Low Cost Flame Retardants for Polyethylene" Dover Chemical Company Feb. 2003, 9 pages.
Tremco illbruck B.V.; Cocoband 6069; Apr. 2007; 2 pages.
Tremco illbruck Limited; Alfacryl FR Intumescent Acrylic; Oct. 22, 2007; 2 pages.
Tremco illbruck Limited; Alfasil FR Oct. 22, 2007; 2 pages.
Tremco illbruck Limited; Compriband 600; Oct. 5, 2007; 2 pages.
Tremco illbruck Limited; Compriband Super FR; Dec. 4, 2007; 2 pages.
Tremco illbruck Limited; Technical Data Sheet Product Compriband Super FR; Oct. 18, 2004; 4 pages.

(56) References Cited

OTHER PUBLICATIONS

Tremco Illbruck Limited; Technical Data Sheet Product: Compriband Super; Sep. 29, 2004; 3 pages.
Tremco illbruck Limited; TechSpec Division Facade & Roofing Solutions; Mar. 2005; 10 pages.
Tremco illbruck; Alfas Bond; Apr. 13, 2007; 2 pages.
Tremco Illbruck; illmod 600; Jun. 2006; 2 pages.
Tremco illbruck; The Specification Product Range; Feb. 2007; 36 pages.
Tremco-illbruck Ltd.; Webbflex B1 PU Foam; Nov. 9, 2006; 2 pages.
Thomas Dunn, International Preliminary Report on Patentability—PCT/US06/60096, dated Oct. 21, 2008, 6 pages, USPTO, USA.
Underwriter Laboratories Inc.; UL 2079 Tests for Fire Resistance of Building Joint Systems; Jun. 30, 2008; 38 pages.
Underwriter Laboratories LLC; System No. WW-S-0007 Joint Systems; Dec. 5, 1997 pages.
Underwriters Laboratories; Fire-resistance ratings ANSI/UL 263; 2014; 24 pages.
Underwriters Laboratories; UL 263 Fire Tests of Building Construction and Materials; Apr. 4, 2003; 40 pages.
Lee W. Young, International Search Report, PCT/US06/60096, dated Oct. 23, 2007, 2 pages, USPTO, USA.
BEJS System, Mar. 2009, 2 pages, Emseal Joint Systems, Ltd., USA.
Adolf Wurth GmbH & Co. KG; 81 Elastic Joint Sealing Tape; retrieved Aug. 5, 2005; 4 pages.
Amber Composites; Expanding PU Foam Technical Data Sheet (Premier BG1); Feb. 1997; 2 pages.
ASTM International; ASTM E84-04; 2004; 19 pages.
ASTM International; Designation E 176-07 Standard Terminology of Fire Standards; 2007; 20 pages.
ASTM International; Standard Terminology of Fire Standards; Nov. 11, 2014; 20 pages.
Auburn Manufacturing Company; Auburn Product News—R-10400M; Dec. 2007; 1 page.
AWCI Construction Dimensions; Where's the Beef in Joint Sealants? Hybrids Hold the Key by Lester Hensley; Jan. 2006 3 pages.
British Board of Agrement; Compriband 600 Sealing Tapes—Certificate 96/3309; Jul. 14, 2005; 8 page.
British Board of Agrement; Compriband Super—Certificate 97/3331; Aug. 2, 2005; 4 pages.
British Board of Agrement; Illmod 600 Sealing Tapes; Mar. 26, 2003; 8 pages.
British Standards Institute; Translation—NEN 6069; Oct. 1991; 31 pages.
British Standards Institution; Fire tests on building materials and structures (BS476:Part 20); 1987; 44 pages.
Building and Engineering Standards Committee; Impregnated cellular plastics strips for sealing external joints—DIN 18542; Jan. 1999; 10 pages.
BuildingTalk; Choosing a sealant for building applications by Lester Hensley CEO and President of Emseal; May 21, 2007; 6 pages.
Centre for Fire Research; Determination of the Fire Resistance According to NEN 6069 of Joints in a Wall Sealed with Cocoband 6069 Impregnated Foam Strip; Nov. 1996; 19 pages.
DIN ev; Fire behavior of building materials and building components; Sep. 1977; 11 pages.
DIN ev; Fire behavior of building materials and building components; May 1998; 33 pages.
DIN ev; Fire behavior of building materials and elements; Mar. 1994; 144 pages.
Dow Corning; Dow Corning 790 Silicone Building Sealant; 1999; 8 pages.
Dow Corning; Dow Corning 790 Silicone Building Sealant; 2000; 6 pages.
Dow Corning; Dow Corning 790 Silicone Building Sealant; 2004; 4 pages.
Dow Corning; Dow Corning Firestop 400 Silicone Sealant; Jan. 15, 2001; 4 pages.
Dow Corning; Dow Corning Firestop 700 Silicone Sealant; Jan. 15, 2001; 6 pages.
Emseal Joint Systems Ltd.; Horizontal Colorseal Aug. 2000 2 pages.
Emseal Joint Systems Ltd.; Colorseal PC/SA Stick; 1 page; Jun. 7, 1995.
Emseal Joint Systems Ltd.; SJS-100-CHT-RN; 1 page; Nov. 20, 2007.
Emseal Joint Systems Ltd; 20H System Tech Data; Jun. 1997; 2 pages.
Emseal Joint Systems Ltd; Colorseal Aug. 2000 2 pages.
Emseal Joint Systems Ltd; DSH System; Nov. 2005; 2 pages.
Emseal Joint Systems Ltd; Fire-Rating of Emseal 20H System; Author of "LH"; Feb. 17, 1993/Apr. 18, 1993; 2 pages.
Emseal Joint Systems Ltd; Horizontal Colorseal Tech Data; Jun. 1997; 2 pages.
Emseal Joint Systems Ltd; Preformed Sealants and Expansion Joint Systems; May 2002, 4 pages.
Emseal Joint Systems Ltd; Preformed Sealants and Expansion Joints.; Jan. 2002; 4 pages.
Emseal Joint Systems Ltd; Seismic Colorseal; Apr. 1998; 2 pages.
Emseal Joint Systems; Seismic Colorseal; Aug. 2000; 2 pages.
Emseal; Benchmarks of Performance for High Movement Acrylic-Impregnated Precompressed Foam Sealants; Aug. 21, 2007; 7 pages.
Emseal; Seismic Colorseal-DS (Double Sided); Apr. 12, 2007; 4 pages.
Envirograf; Fire Kills; 2004; 8 pages available by at least Nov. 10, 2006 per Archive.org.
Fire Retardants Inc.; Fire Barrier CP 25WB + Caulk; 2002; 4 pages.
IBMB; Test 3002/2719—Blocostop F120; Mar. 24, 2000; 14 pages.
IBMB; Test 3263/5362—Firestop N; Jul. 18, 2002; 13 pages.
IBMB; Test 3568/2560; Sep. 30, 2005; 14 pages.
IFT Rosenheim; Evidence of Performance—Test Report 105 32469/1e U R1; Apr. 19, 2006; 8 pages.
Illbruck Bau-Produkte GmbH u Co. KG; Willseal Firestop; Sep. 30, 1995; 2 pages.
Illbruck Inc.; Will-Seal 250 Spec Data; Aug. 1989; 2 pages.
Illbruck International; willseal the joint sealing tape; Jan. 1991; 19 pages.
Illbruck Sealant Systems inc..; Illbruck Willseal 600; Sep. 2001; 2 pages.
Illbruck USA; MSDS—Willseal 150/250 and/or EPS; Jul. 21, 1986; 2 pages.
Illbruck/USA; Will-Seal 150 Spec Data; Nov. 1987; 2 pages.
Iso Chemie GmbH; Iso-Bloco 600; 2 pages; Jul. 1, 2006.
Harry Kim; International Preliminary Report on Patentability for PCT Application No. PCT/US17/17132; dated Feb. 6, 2018; 6 pages; USPTO as IPEA; Alexandria, Virginia.
20H System Tech Data, Jun. 1997, 2 pages, Emseal Joint Systems, Ltd., USA.
Horizontal Colorseal Tech Data, Jun. 1997, 2 pages, Emseal Joint Systems, Ltd.
Emseal Acrylic Log Home Tape Installation Instructions, Jun. 2011, 1 page, Emseal Joint Systems, Ltd., retrieved on Mar. 30, 2016 from https://web.archive.org/web/20160330181621/http://www.emseal.com/Products- /Specialty/LogHome/AcrylicLogHome.sub.-Tapes.sub.--Install.sub.--X.pdf.
Emseal BEJS System—Bridge Expansion Joint System, May 26, 2010, 5 pages, Emseal Joint Systems, Ltd., retrieved on Mar. 30, 2016 from https://web.archive.org/web/20100526081854/http://www.emseal.com/products- /Infrastructure/BridgeJointSeals/BEJSBridgeJointSystem.htm.
Dow Corning 890-SL Self-Leveling Silicone Joint Sealant, 2005, 4 pages, USA.
Install Data—Horizontal Colorseal—with Epoxy Adhesive, Jun. 1997, 2 pages, Emseal Joint Systems, Ltd., USA.
Backerseal (Greyflex), Sep. 2001, 2 pages, Emseal Joint Systems, Ltd., USA.
Emseal Emshield DFR2 System DFR3 System Tech Data, May 2010, 4 pages, Emseal Joint Systems, Ltd., USA.

(56) References Cited

OTHER PUBLICATIONS

Seismic Colorseal by Emseal, Aug. 21, 2007, 4 pages, Emseal Corporation, USA.
Universal 90's, Aug. 4, 2009, 4 pages, Emseal Joint Systems, Ltd., USA.
Specified Technologies, Inc.; Product Data Sheet PEN200 Silicone Foam; 2003; 2 pages.
Specified Technologies, Inc.; Product Data Sheet SpecSeal Series ES Elastomeric Sealant; 2004; 4 pages.
Specified Technologies, Inc.; Product Data Sheet SpecSeal Series ES Elastomeric Sealant; 2000; 4 pages.
Specified Technologies, Inc.; Product Data Sheet PEN300 Silicone Foam; 2004; 4 pages.
Specified Technologies, Inc.; Firestop Submittal Package; 2004; 37 pages.
XHBN Joint Systems Data Sheet (retrieved Sep. 6, 2017 from http://database.ul.com/cgi-bin/XYV/template/LISEXT/1FRAME/showpage.html?name=XHBN.WW-D-0109 &ccnshorttitle=Joint+Systems&objid=1082471571 &cfgid=1073741824&version=versionless &parent_id=1073995560&sequence=1).
"Protecting the Foundation of Fire-safety" by Robert Berhinig, P.E. (IAEI News, Jul./Aug. 2002).
Hai Vo; Final Office Action for U.S. Appl. No. 14/630,125; dated May 13, 2016; 11 pages; USPTO; Alexandria, Virginia.
Hai Vo; Non-Final Office Action for U.S. Appl. No. 14/630,125; dated Feb. 8, 2016; 8 pages; USPTO; Alexandria, Virginia.
Hai Vo; Notice of Allowance for U.S. Appl. No. 14/630,125; dated Jun. 14, 2016; 12 pages; USPTO; Alexandria, Virginia.
Beth A. Stephan; Notice of Allowance for U.S. Appl. No. 14/643,031; dated Oct. 28, 2015; 8 pages; USPTO; Alexandria, Virginia.
Paola Agudelo; Final Office Action for U.S. Appl. No. 15/046,924; dated May 10, 2017; 13 pages; USPTO; Alexandria, Virginia.
Paola Agudelo; Non-Final Office Action for U.S. Appl. No. 15/046,924; dated Dec. 12, 2016; 12 pages; USPTO; Alexandria, Virginia.
Paola Agudelo; Notice of Allowance for U.S. Appl. No. 15/046,924; dated Jul. 6, 2017; 7 pages; USPTO; Alexandria, Virginia.
Gilbert Y. Lee; Notice of Allowance for U.S. Appl. No. 15/217,085; dated Sep. 13, 2017; 8 pages; USPTO; Alexandria, Virginia.
Paola Agudelo; Non-Final Office Action for U.S. Appl. No. 15/648,908; dated Oct. 4, 2017; 11 pages; USPTO; Alexandria, Virginia.
Paola Agudelo; Notice of Allowance for U.S. Appl. No. 15/648,908; dated Oct. 27, 2017; 8 pages; USPTO; Alexandria, Virginia.
Gilbert Y. Lee; Notice of Allowance for U.S. Appl. No. 15/649,927; dated Nov. 8, 2017; 7 pages; USPTO; Alexandria, Virginia.
Gilbert Y. Lee; Notice of Allowance for U.S. Appl. No. 15/677,811; dated Nov. 28, 2017; 7 pages; USPTO; Alexandria, Virginia.
Beth A. Stephan; Non-Final Office Action for U.S. Appl. No. 15/681,500; dated Jan. 5, 2018; 10 pages; USPTO; Alexandria, Virginia.
John Nguyen; International Preliminary Report on Patentability for PCT Application No. PCT/US16/19059; dated May 30, 2017; 6 pages; USPTO as IPEA; Alexandria, Virginia.
Shane Thomas; International Search Report and Written Opinion for PCT Application No. PCT/US16/19059; dated May 20, 2016; 7 pages; USPTO as ISA; Alexandria, Virginia.
Harry C. Kim; International Preliminary Report on Patentability for PCT Application No. PCT/US16/66495; dated Jan. 18, 2018; 8 pages; USPTO as IPEA; Alexandria, Virginia.
Shane Thomas; International Search Report and Written Opinion for PCT Application No. PCT/US16/66495; dated Feb. 27, 2017; 7 pages; USPTO as ISA; Alexandria, Virginia.
Shane Thomas; International Search Report and Written Opinion for PCT Application No. PCT/US17/17132; dated May 4, 2017; 6 pages; USPTO as ISA; Alexandria, Virginia.
"Thermaflex Parking Deck Expansion Joint", EMSEAL (retrieved on Oct. 13, 2017 from https://www.emseal.com/product/thermaflex-parking-deck-expansion-joint/).
"Jeene—Bridge Series", BASF (retrieved on Oct. 13, 2017 from https://wbacorp.com/products/bridge-highway/joint-seals/jeene-bridge).
UL LLC, System No. WW-D-1148, UL Online Certifications Directory, Jul. 22, 2015, retrieved Sep. 5, 2017 from http://database.ul.com/cgi-bin/XYV/template/LISEXT/1FRAME/showpage.html?name=XHBN.WW-D-1148&ccnshorttitle=Joint+Systems &objid=1083778206&cfgid=1073741824&version=versionless &parent_id=1073995560&sequence=1, 1 page, Northbrook, Illinois.
UL LLC, System No. WW-D-1173, UL Online Certifications Directory, May 12, 2015, retrieved Sep. 5, 2017 from http://database.ul.com/cgi-bin/XYV/template/LISEXT/1FRAME/showpage.html?name=XHBN.WW-D-1173&ccnshorttitle=Joint+Systems &objid=1084832391&cfgid=1073741824&version=versionless &parent_id=1073995560&sequence=1, 1 page, Northbrook, Illinois.
UL LLC, System No. WW-D-1148 for Canada, UL Online Certifications Directory, Jul. 22, 2015, retrieved Sep. 5, 2017 from http://database.ul.com/cgi-bin/XYV/template/LISEXT/1FRAME/showpage.html?name=XHBN7.WW-D-1148 &ccnshorttitle=Joint+Systems+Certified+for+Canada &objid=1083778211&cfgid=1073741824&version=versionless &parent_id=1073995562&sequence=1, 1 page, Northbrook, Illinois.
UL LLC, System No. WW-D-1173, UL Online Certifications Directory, May 12, 2015, retrieved Sep. 5, 2017 from http://database.ul.com/cgi-bin/XYV/template/LISEXT/1FRAME/showpage.html?name=XHBN7.WW-D-1173 &ccnshorttitle=Joint+Systems+Certified+for+Canada &objid=1084832396&cfgid=1073741824&version=versionless &parent_id=1073995562&sequence=1, 1 page, Northbrook, Illinois.
Balco, Inc, CE Series Expansion Joint Seals with METABLOCK. Sep. 28, 2015, retrieved Sep. 5, 2017 from https://balcousa.com/metablock-ce-fire-barrier-2/, 1 page, Wichita, Kansas, USA.
UL, LLC; Online Certifications Directory; "System No. WW-D-1092, XHBN.WW-D-1092 Joint Systems"; Sep. 24, 2012; retrieved on Feb. 1, 2018 from http://database.ul.com/cgi-bin/XYV/template/LISEXT/1FRAME/showpage.html?name=XHBN.WW-D-1092 &ccnshorttitle=Joint+Systems&objid=1082471646 &cfgid=1073741824&version=versionless &parent_id=1073995560&sequence=1; 2 pages.
UL, LLC; Online Certifications Directory; "System No. WW-D-1093, XHBN.WW-D-1093 Joint Systems";Oct. 6, 2014; retrieved on Feb. 1, 2018 from http://database.ul.com/cgi-bin/XYV/template/LISEXT/1FRAME/showpage.html?name=XHBN.WW-D-1093 &ccnshorttitle=Joint+Systems&objid=1082823956 &cfgid=1073741824&version=versionless &parent_id=1073995560&sequence=1; 3 pages.
UL, LLC; Online Certifications Directory; "System No. HW-D-1098, XHBN.HW-D-1098 Joint Systems"; Jun. 6, 2013; retrieved on Feb. 1, 2018 from http://database.ul.com/cgi-bin/XYV/template/LISEXT/1FRAME/showpage.html?name=XHBN.HW-D-1098 &ccnshorttitle=Joint+Systems&objid=1082700131 &cfgid=1073741824&version=versionless &parent_id=1073995560&sequence=1; 3 pages.
UL, LLC; Online Certifications Directory; "System No. FF-D-1100, XHBN.FF-D-1100 Joint Systems"; Sep. 24, 2012; retrieved on Feb. 1, 2018 from http://database.ul.com/cgi-bin/XYV/template/LISEXT/1FRAME/showpage.html?name=XHBN.FF-D-1100 &ccnshorttitle=Joint+Systems&objid=1082567162 &cfgid=1073741824&version=versionless &parent_id=1073995560&sequence=1; 2 pages.
UL, LLC; Online Certifications Directory; "System No. WW-D-1101, XHBN.WW-D-1101 Joint Systems"; Oct. 6, 2014; retrieved on Feb. 1, 2018 from http://database.ul.com/cgi-bin/XYV/template/LISEXT/1FRAME/showpage.html?name=XHBN.WW-D-1101 &ccnshorttitle=Joint+Systems&objid=1082823966

(56) References Cited

OTHER PUBLICATIONS

&cfgid=1073741824&version=versionless
&parent_id=1073995560&sequence=1; 2 pages.
UL, LLC; Online Certifications Directory; "System No. WW-D-1102, XHBN.WW-D-1102 Joint Systems"; Sep. 24, 2012; retrieved on Feb. 1, 2018 from http://database.ul.com/cgi-bin/XYV/template/LISEXT/1FRAME/showpage.html?name=XHBN.WW-D-1102
&ccnshorttitle=Joint+Systems&objid=1082699876
&cfgid=1073741824&version=versionless
&parent_id=1073995560&sequence=1; 2 pages.
UL, LLC; Online Certifications Directory; "System No. FF-D-1109, XHBN.FF-D-1109 Joint Systems"; Jul. 29, 2013; retrieved on Feb. 1, 2018 from http://database.ul.com/cgi-bin/XYV/template/LISEXT/1FRAME/showpage.html?name=XHBN.FF-D-1109
&ccnshorttitle=Joint+Systems&objid=1082845106
&cfgid=1073741824&version=versionless
&parent_id=1073995560&sequence=1; 2 pages.
UL, LLC; Online Certifications Directory; "System No. FF-D-1110, XHBN.FF-D-1110 Joint Systems"; Nov. 1, 2013; retrieved on Feb. 1, 2018 from http://database.ul.com/cgi-bin/XYV/template/LISEXT/1FRAME/showpage.html?name=XHBN.FF-D-1110
&ccnshorttitle=Joint+Systems&objid=1082845102
&cfgid=1073741824&version=versionless
&parent_id=1073995560&sequence=1; 2 pages.
UL, LLC; Online Certifications Directory; "System No. WW-D-1119, XHBN.WW-D-1119 Joint Systems"; Jul. 29, 2013; retrieved on Feb. 1, 2018 from http://database.ul.com/cgi-bin/XYV/template/LISEXT/1FRAME/showpage.html?name=XHBN.WW-D-1119
&ccnshorttitle=Joint+Systems&objid=1083149741
&cfgid=1073741824&version=versionless
&parent_id=1073995560&sequence=1; 3 pages.
UL, LLC; Online Certifications Directory; "System No. WW-D-1120, XHBN.WW-D-1120 Joint Systems"; Jun. 6, 2013; retrieved on Feb. 1, 2018 from http://database.ul.com/cgi-bin/XYV/template/LISEXT/1FRAME/showpage.html?name=XHBN.WW-D-1120
&ccnshorttitle=Joint+Systems&objid=1083149707
&cfgid=1073741824&version=versionless
&parent_id=1073995560&sequence=1; 2 pages.
UL, LLC; Online Certifications Directory; "System No. FF-D-1148, XHBN.FF-D-1148 Joint Systems"; May 15, 2014; retrieved on Feb. 1, 2018 from http://database.ul.com/cgi-bin/XYV/template/LISEXT/1FRAME/showpage.html?name=XHBN.FF-D-1148
&ccnshorttitle=Joint+Systems&objid=1084034211
&cfgid=1073741824&version=versionless
&parent_id=1073995560&sequence=1; 2 pages.
UL, LLC; Online Certifications Directory; "System No. WW-D-1152, XHBN.WW-D-1152 Joint Systems"; Aug. 14, 2014; retrieved on Feb. 1, 2018 from http://database.ul.com/cgi-bin/XYV/template/LISEXT/1FRAME/showpage.html?name=XHBN.WW-D-1152
&ccnshorttitle=Joint+Systems&objid=1084034221
&cfgid=1073741824&version=versionless
&parent_id=1073995560&sequence=1; 2 pages.
UL, LLC; Online Certifications Directory; "System No. WW-D-1153, XHBN.WW-D-1153 Joint Systems"; Aug. 20, 2014; retrieved on Feb. 1, 2018 from http://database.ul.com/cgi-bin/XYV/template/LISEXT/1FRAME/showpage.html?name=XHBN.WW-D-1153
&ccnshorttitle=Joint+Systems&objid=1084052791
&cfgid=1073741824&version=versionless
&parent_id=1073995560&sequence=1; 2 pages.
UL, LLC; Online Certifications Directory; "System No. WW-D-1154, XHBN.WW-D-1154 Joint Systems"; Jun. 16, 2014; retrieved on Feb. 1, 2018 from http://database.ul.com/cgi-bin/XYV/template/LISEXT/1FRAME/showpage.html?name=XHBN.WW-D-1154
&ccnshorttitle=Joint+Systems&objid=1084052801
&cfgid=1073741824&version=versionless
&parent_id=1073995560&sequence=1; 2 pages.
UL, LLC; Online Certifications Directory; "System No. FF-D-1156, XHBN.FF-D-1156 Joint Systems"; Nov. 9, 2015; retrieved on Feb. 1, 2018 from http://database.ul.com/cgi-bin/XYV/template/LISEXT/1FRAME/showpage.html?name=XHBN.FF-D-1156
&ccnshorttitle=Joint+Systems&objid=1085235671
&cfgid=1073741824&version=versionless
&parent_id=1073995560&sequence=1; 2 pages.
UL, LLC; Online Certifications Directory; "System No. FF-D-1157, XHBN.FF-D-1157 Joint Systems"; Nov. 9, 2015; retrieved on Feb. 1, 2018 from http://database.ul.com/cgi-bin/XYV/template/LISEXT/1FRAME/showpage.html?name=XHBN.FF-D-1157
&ccnshorttitle=Joint+Systems&objid=1085235726
&cfgid=1073741824&version=versionless
&parent_id=1073995560&sequence=1; 2 pages.
Schul International; Firejoint 2FR-H & Firejoint 3FR-H; 2012; 2 pages.
Schul International; Firejoint 2FR-V & Firejoint 3FR-V; 2012; 2 pages.
UL, LLC; Online Certifications Directory; "System No. HW-D-1101, XHBN.HW-D-1101 Joint Systems"; Sep. 11, 2013; retrieved on Feb. 1, 2018 from http://database.ul.com/cgi-bin/XYV/template/LISEXT/1FRAME/showpage.html?name=XHBN.HW-D-1101
&ccnshorttitle=Joint+Systems&objid=1083156306
&cfgid=1073741824&version=versionless
&parent_id=1073995560&sequence=1; 3 pages.
UL, LLC; Online Certifications Directory; "System No. FF-D-1121, XHBN.FF-D-1121 Joint Systems"; Apr. 25, 2013; retrieved on Feb. 1, 2018 from http://database.ul.com/cgi-bin/XYV/template/LISEXT/1FRAME/showpage.html?name=XHBN.FF-D-1121
&ccnshorttitle=Joint+Systems&objid=1083156406
&cfgid=1073741824&version=versionless
&parent_id=1073995560&sequence=1; 2 pages.
UL, LLC; Online Certifications Directory; "System No. FF-D-1122, XHBN.FF-D-1122 Joint Systems"; Sep. 11, 2013; retrieved on Feb. 1, 2018 from http://database.ul.com/cgi-bin/XYV/template/LISEXT/1FRAME/showpage.html?name=XHBN.FF-D-1122
&ccnshorttitle=Joint+Systems&objid=1083156361
&cfgid=1073741824&version=versionless
&parent_id=1073995560&sequence=1; 2 pages.
UL, LLC; Online Certifications Directory; "System No. FF-D-1123, XHBN.FF-D-1123 Joint Systems"; Sep. 11, 2013; retrieved on Feb. 1, 2018 from http://database.ul.com/cgi-bin/XYV/template/LISEXT/1FRAME/showpage.html?name=XHBN.FF-D-1123
&ccnshorttitle=Joint+Systems&objid=1083156331
&ofgid=1073741824&version=versionless
&parent_id=1073995560&sequence=1; 2 pages.
UL, LLC; Online Certifications Directory; "System No. WW-D-1124, XHBN.WW-D-1124 Joint Systems"; Sep. 11, 2013; retrieved on Feb. 1, 2018 from http://database.ul.com/cgi-bin/XYV/template/LISEXT/1FRAME/showpage.html?name=XHBN.WW-D-1124
&ccnshorttitle=Joint+Systems&objid=1083156186
&cfgid=1073741824&version=versionless
&parent_id=1073995560&sequence=1; 2 pages.
UL, LLC; Online Certifications Directory; "System No. WW-D-1125, XHBN.WW-D-1125 Joint Systems"; Apr. 25, 2013; retrieved on Feb. 1, 2018 from http://database.ul.com/cgi-bin/XYV/template/LISEXT/1FRAME/showpage.html?name=XHBN.WW-D-1125
&ccnshorttitle=Joint+Systems&objid=1083156176
&cfgid=1073741824&version=versionless
&parent_id=1073995560&sequence=1; 2 pages.
UL, LLC; Online Certifications Directory; "System No. WW-D-1126, XHBN.WW-D-1126 Joint Systems"; Sep. 11, 2013; retrieved on Feb. 1, 2018 from http://database.ul.com/cgi-bin/XYV/template/LISEXT/1FRAME/showpage.html?name=XHBN.WW-D-1126
&ccnshorttitle=Joint+Systems&objid=1083156461
&cfgid=1073741824&version=versionless
&parent_id=1073995560&sequence=1; 2 pages.
UL, LLC; Online Certifications Directory; "System No. WW-D-1127, XHBN.WW-D-1127 Joint Systems"; Sep. 11, 2013; retrieved on Feb. 1, 2018 from http://database.ul.com/cgi-bin/XYV/template/LISEXT/1FRAME/showpage.html?name=XHBN.WW-D-1127
&ccnshorttitle=Joint+Systems&objid=1083156441
&cfgid=1073741824&version=versionless
&parent_id=1073995560&sequence=1; 3 pages.
UL, LLC; Online Certifications Directory; "System No. FF-D-1151, XHBN.FF-D-1151 Joint Systems"; Aug. 20, 2014; retrieved on Feb. 1, 2018 from http://database.ul.com/cgi-bin/XYV/template/

(56) References Cited

OTHER PUBLICATIONS

LISEXT/1FRAME/showpage.html?name=XHBN.FF-D-1151 &ccnshorttitle=Joint+Systems&objid=1084241891 &cfgid=1073741824&version=versionless &parent_id=1073995560&sequence=1; 2 pages.
UL, LLC; Online Certifications Directory; "System No. WW-D-1160, XHBN.WW-D-1160 Joint Systems"; Aug. 20, 2014; retrieved on Feb. 1, 2018 from http://database.ul.com/cgi-bin/XYV/template/LISEXT/1FRAME/showpage.html?name=XHBN.WW-D-1160 &ccnshorttitle=Joint+Systems&objid=1084241902 &cfgid=1073741824&version=versionless &parent_id=1073995560&sequence=1; 2 pages.
UL, LLC; Online Certifications Directory; "System No. WW-D-1161, XHBN.WW-D-1161 Joint Systems"; Aug. 20, 2014; retrieved on Feb. 1, 2018 from http://database.ul.com/cgi-bin/XYV/template/LISEXT/1FRAME/showpage.html?name=XHBN.WW-D-1161 &ccnshorttitle=Joint+Systems&objid=1084241911 &cfgid=1073741824&version=versionless &parent_id=1073995560&sequence=1; 3 pages.
UL, LLC; Online Certifications Directory; "System No. WW-D-1162, XHBN.WW-D-1162 Joint Systems"; Aug. 20, 2014; retrieved on Feb. 1, 2018 from http://database.ul.com/cgi-bin/XYV/template/LISEXT/1FRAME/showpage.html?name=XHBN.WW-D-1162 &ccnshorttitle=Joint+Systems&objid=1084241921 &cfgid=1073741824&version=versionless &parent_id=1073995560&sequence=1; 2 pages.
UL, LLC; Online Certifications Directory; "System No. FF-D-1174, XHBN.FF-D-1174 Joint Systems"; Jul. 11, 2016; retrieved on Feb. 1, 2018 from http://database.ul.com/cgi-bin/XYV/template/LISEXT/1FRAME/showpage.html?name=XHBN.FF-D-1174 &ccnshorttitle=Joint+Systems&objid=1085930212 &cfgid=1073741824&version=versionless &parent_id=1073995560&sequence=1; 2 pages.
UL, LLC; Online Certifications Directory; "System No. FF-D-1175, XHBN.FF-D-1175 Joint Systems"; Jul. 12, 2016; retrieved on Feb. 1, 2018 from http://database.ul.com/cgi-bin/XYV/template/LISEXT/1FRAME/showpage.html?name=XHBN.FF-D-1175 &ccnshorttitle=Joint+Systems&objid=1085930226 &cfgid=1073741824&version=versionless &parent_id=1073995560&sequence=1; 2 pages.
Willseal, LLC; Willseal FR-2V; Mar. 4, 2013; 6 pages.
Willseal, LLC; Willseal FR-2H; Mar. 4, 2013; 6 pages.
Willseal, LLC; Willseal FR-V; dated 2013; 6 pages.
Willseal, LLC; Willseal FR-H; dated 2013; 6 pages.
Schul International Company, LLC; Firejoint 2FR-H & Firejoint 2FR-V; Aug. 2014; 3 pages.
Willseal, LLC; Willseal FR-2H & Willseal FR-2V; Mar. 4, 2013; 3 pages.
Willseal LLC; Willseal FR-H / Willseal FR-V; Oct. 2016; retrieved on Feb. 2, 2018 from https://willseal.com/wp-content/uploads/2016/10/WillsealFR_Install.pdf; 3 pages.
Schul International Company, LLC; Sealtite 50N; May 9, 2007; 2 pages.
Schul International Company, LLC; Seismic Sealtite; May 9, 2007; 2 pages.
Willseal LLC; MSDS for Willseal FR-V & FR-H; Jul. 19, 2013; 11 pages.
Schul International Company, LLC; Firejoint 2FR-V +50; dated 2012; 2 pages.
Stephan, Beth A; Non-Final Office Action for U.S. Appl. No. 15/681,500; dated Mar. 20, 2018; 7 pages; USPTO; Alexandria, Virginia.
Agudelo, Paola; Non-Final Office Action for U.S. Appl. No. 15/885,028; dated Mar. 30, 2018; 7 pages; USPTO; Alexandria, Virginia.
Hai Vo; Non-Final Office Action for U.S. Appl. No. 15/189,671; dated Mar. 7, 2018; 17 pages; USPTO; Alexandria, Virginia.
UFP Technologies; Polyethylene Foam Material; Dated Jan. 8, 2012; retrieved from https://web.archive.org/web/20120108003656/http://www.ufpt.com:80/materials/foam/polyethylene-foam.html on Mar. 7, 2018; 1 page.
Hai Vo; Final Office Action for U.S. Appl. No. 15/189,671; dated May 31, 2018; 14 pages; USPTO; Alexandria, Virginia.

EXPANSION JOINT SEAL SYSTEM

CROSS-REFERENCE TO RELATED APPLICATIONS

This application is a continuation-in-part of U.S. patent application Ser. No. 15/681,500 for "Expansion Joint Seal System," filed Aug. 21, 2017, which is a continuation of PCT Patent Application Ser. No. PCT/US16/19059 for "Expansion Joint Seal System", filed Feb. 23, 2016 which is incorporated herein by reference, which is a continuation of U.S. patent application Ser. No. 14/643,031 for "Expansion Joint Seal System," filed Mar. 10, 2015, now U.S. Pat. No. 9,206,596, which is incorporated herein by reference.

STATEMENT REGARDING FEDERALLY SPONSORED RESEARCH OR DEVELOPMENT

Not Applicable.

BACKGROUND

Field

The present disclosure relates generally to systems for creating a durable water-resistant seal between adjacent panels subject to temperature expansion and contraction which further provides some protection for exposed surfaces against extreme heat. More particularly, the present disclosure is directed to providing an expansion joint seal system which includes intumescent to protect uncoated edges of substrates.

Description of the Related Art

Construction panels come in many different sizes and shapes and may be used for various purposes, including roadways, sideways, and pre-cast structures. Where the construction panels are concrete, it is necessary to form a lateral gap or joint between adjacent panels to allow for independent movement, such in response to ambient temperature variations within standard operating ranges. In light of temperature variations beyond the range, such as incident to a fuel fire or a vehicle fire adjacent the concrete panels, such as roadways or tunnel walls or ceilings, it is further necessary to provide protection to the concrete panels against high temperatures.

Various seal systems and configurations have been used to provide water-retardant seals which also provide fire protection. One technique is to provide a water-retardant seal between construction panels and to overlay the exposed surface of the construction panels with a fire-resistant material, while leaving the water-retardant seal directly exposed to the high temperature. In such systems, the seal system is intended to prevent water and other contaminants from entering the gap or joint between the construction panels during exposure to weather conditions. As the gap or seal is intended to permit expansion of the panels into the gap or seal, the presence of non-flexible contaminants, such as those intended to prevent fire damage, could prevent such expansion and contribute to the increase of stresses and strains within the panels, the seal was permitted to be exposed, while the working surface of the adjacent construction panel was coated with a fire-retardant. Another technique is to provide a compressible foam infused with a fire retardant, which includes an elastomer at its exposed surface and an intumescent at the opposite side, to provide a degree of waterproofing from the exposed surface and a degree of fire-retardant from opposite side or in cases where the elastomer and fire-retardant infused foam were consumed, in whole or in large part, by fire.

These systems, however, do not provide substantive protection of surface of the construction panels perpendicular to the exposed surface against fire. These concrete ends are not protected from the heat, which can cause spalling of the concrete and therefore require replacement of the concrete. Spalling is well-known to be detrimental to the concrete structure, potentially precluding continued use or at requiring substantial and expensive remediation to return to service. While this may be addressed, in part, by overlapping the surface coating and the seal, this has a negative impact on the flexibility of the joint seal.

Alternative systems provide for a backer bar having a combustible closed-cell foam jacket surrounding an intumescent or an intumescent simply having a combustible closed-cell foam cap, wherein a sealant is then applied atop the backer bar. Unfortunately, these systems have little elasticity in light of the composition of intumescent.

Finally, other systems are known wherein the intumescent is positioned as far distant the exposed surface as possible, at the bottom of a spline connected to an expansion joint cover.

It would be an improvement to the art to provide an expansion joint seal which would provide a long-life water-resistant seal through the ambient temperature range which would also provide a degree of intumescent protection of the exposed ends of construction panels in the event of temperature immediately above the ambient temperature range.

SUMMARY

The present disclosure therefore meets the above needs and overcomes one or more deficiencies in the prior art by an expansion joint seal system which provides the fire protection of an intumescent to the exposed ends of construction panels while providing an elastic seal to protect the construction panels against contaminants and temperature fluctuations.

The disclosure provides a fire rated compressed expansion joint sealant having an intumescent proximate its top, so that when exposed to fire, the intumescent expands to protect the exposed vertical surface of the adjacent concrete substrate. The concrete end is therefore protected from the heat, which can cause spalling of the concrete. The horizontal surface of the concrete is largely already protected in practice due to application of a fire resistant coating. The end of the concrete is therefore protected in a manner which does not require joint overlap between the horizontal fire resistant coating and the compressible sealant. Providing a compressible sealant provides the advantage of the expansion joint, which compresses and expands due to conditions on the concrete, and does not need mechanical fasteners or protective cover plates.

In one embodiment, the present disclosure provides an expansion joint system for imposition under compression between a first substrate and a second substrate having a fire retardant body of compressible foam and a first intumescent member positioned to protect the adjacent substrate edge upon heating due to fire. The expansion joint system is intended for use in connection with a first substrate and a second substrate both generally co-planar, i.e. in most cases substantially but not necessarily precisely co-planar, with a first plane and separated from one another by a first distance. Each substrate has a substrate thickness and a substrate end face generally perpendicular, i.e. in most cases substantially but not necessarily precisely perpendicular, to the first plane. In particular, the expansion joint system uses a body of compressible foam having a body first face, a body first face segment proximate the first face, a body second face opposite the body first face, a body second face segment proximate the body second face, a body top, a body bottom opposite the body top, a body width, a body thickness, and a body length. In operation, when the body is compressed and imposed between the two substrates, the body first face contacts the first substrate end face while the body second face contacts the second substrate end face. The body has a body width extending from the body first face to the body second face and which is greater than the first distance, thus resulting in compression of the body when imposed between the substrates. The body also has a body thickness which extends from the body top to the body bottom and which is equivalent to, and therefore may be greater, equal or less than, the first substrate thickness or the second substrate thickness, but which is sized to both substrate thicknesses. The first intumescent member is defined by a first intumescent member first outer surface, a first intumescent member second outer surface, and by a first intumescent member length, which is equivalent to the body length. The first intumescent member is made integral to the body of compressible foam so that the first intumescent member first outer surface is generally aligned with the body first face, i.e. in most cases substantially but not necessarily precisely aligned.

In an alternative embodiment, an expansion joint system is provided for imposition under compression between a first substrate and a second substrate and comprises a body of compressible foam and a first intumescent member. The body of compressible foam is fire retardant and has a body first face, a body second face opposite the body first face, a body top, a body bottom opposite the body top, a body thickness extending from the body top to the body bottom, a body length, and a first body channel in the body of compressible foam in the body first face near the body top along the body length. The first intumescent member has a first intumescent member first outer surface, a first intumescent member second outer surface, and a first intumescent member length equivalent to the body length, is adhered to the body of compressible foam at the first intumescent member second outer surface, is positioned in the first body channel, and is generally aligned with the body first face, i.e. in most cases substantially but not necessarily precisely aligned. The body channel is found in the top third of the body thickness and extending from the body first face not more than one quarter of the distance from the body first face and the body second face.

In another alternative embodiment, an expansion joint system is provided for imposition under compression between a first substrate and a second substrate and comprises a body of compressible foam and a first intumescent member. The body of compressible foam is fire retardant and has a body first face, a body second face opposite the body first face, a body top, a body bottom opposite the body top, a body thickness extending from the body top to the body bottom, and a body length. The first intumescent member is made integral with the body of compressible foam by force injection of a then-liquid intumescent into the body of compressible foam in the top third of the body thickness and extending into the body of compressible foam 118 from the body first face toward the second body face 122 not more than one quarter of the distance from the body first face and the body second face.

The present disclosure also provides a method for installing an expansion joint system, comprising compressing one of expansion joint systems previously provides, inserting the expansion joint system into a gap between a first substrate and a second substrate, such as those provided previously, and allowing the compression expansion joint system to decompress in the gap to contact the first substrate and the second substrate.

Notably, the present disclosure provides for an expansion joint system which does not require any destruction of the adjacent substrate, such as by chamfering the edge, for installation and protection of the expansion joint system. It further avoids the need to build up a fire-proof coating onto the substrates bordering the joint in excess of the amount required for concrete protection, merely to increase the height so as to protect an expansion joint system. The present disclosure thus is provided entirely within the joint without the need for additional use of a fire proof coating.

The present disclosure thus provides advantages over the prior art. In high temperature fire, such as in tunnels, there is a rapid temperature rise. Fire-rating of such structures is therefore a concern. The Dutch RWS (Rijkswaterstaat) curve, one standard for fire-rating as known on Aug. 1, 2014, provides a curve that rapidly reaches 1200° C. (2192° F.) in ten (10) minutes before reaching a peak in excess of 1350° C. (2462° F.) at or about one hour. Detailed procedures for such testing can be found in "Fire testing procedure for concrete tunnel linings" by the Ministry of Infrastructure and the Environment, Report 2008-Efectis-R-695 (2013). This Dutch RWS fire-rating is used to certify the fire protection will ensure the concrete and enclosed steel (rebar) below will remain within an acceptable temperature range. The RWS standard, however, is written for protecting the concrete behind a fire protection board or coating and does not address expansion joints. It is foreseeable, with the increasing use of tunneling in established metropolitan areas whether for vehicular passages such as in Boston, Mass. and Seattle, Wash., or in subsurface utility passages, that this or comparable standards may be extended to include expansion joints.

The present disclosure protects not only the concrete below like the prior art, but also the concrete at the front of the joint. The present disclosure thus provides a moving joint, protecting the concrete below to higher time/temperature extreme and the concrete at the front of the joint substrate which lacks a fire protection coating. Thus, the present disclosure provides a joint which provides fire resistance for the passage through the joint and protects the concrete from spalling, causing structural damage, by acting as a fire-rated expansion joint. To that end, the present disclosure provides protection on the front of the joint, to control as much heat and provide protection for the weakest part of the concrete (corner edges at the expansion joint) in case of a fire. The focus of the present disclosure is most important in cases where the fire standard is based around the Dutch RWS fire-rating standard for tunnels and enclosed spaces.

Additionally, due to the flexible nature of the present disclosure, an improved longitudinal shear capability is provided which avoids the failure of rigid structure of the prior art. Prior art, which has used laminates or low compression ratios, often fail under shear, resulting in delamination of the structure. Vertical laminations in particular are known to fail in shear.

Additional aspects, advantages, and embodiments of the disclosure will become apparent to those skilled in the art from the following description of the various embodiments and related drawings.

BRIEF DESCRIPTION OF THE DRAWINGS

So that the manner in which the described features, advantages, and objects of the disclosure, as well as others which will become apparent, are attained and can be understood in detail; more particular description of the disclosure briefly summarized above may be had by referring to the embodiments thereof that are illustrated in the drawings, which drawings form a part of this specification. It is to be noted, however, that the appended drawings illustrate only typical preferred embodiments of the disclosure and are therefore not to be considered limiting of its scope as the disclosure may admit to other equally effective embodiments.

In the drawings.

DETAILED DESCRIPTION

Figure 1:
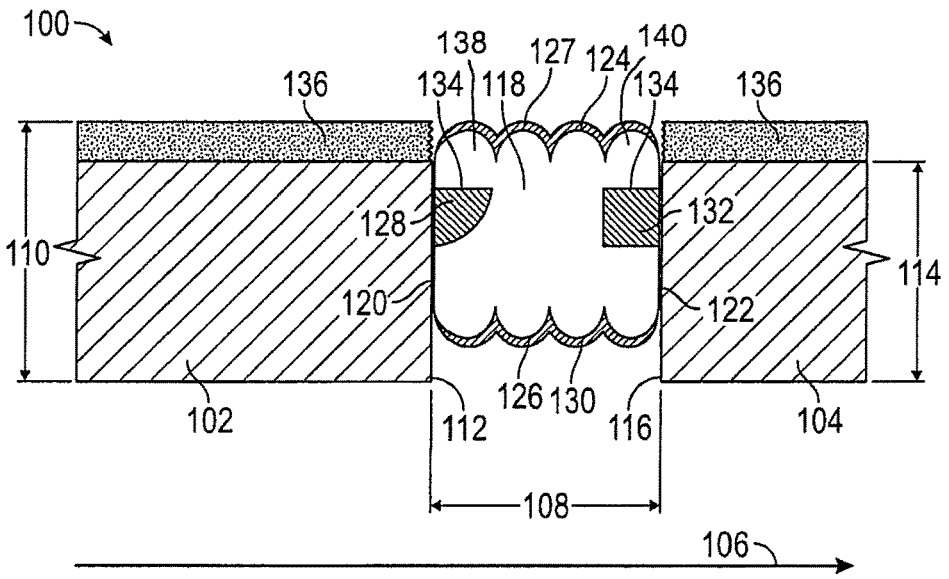
FIG. 1 is an illustration of a side view of the expansion joint system of the present disclosure installed between two substrates to extend above the top of the adjacent substrates.
Figure 5:
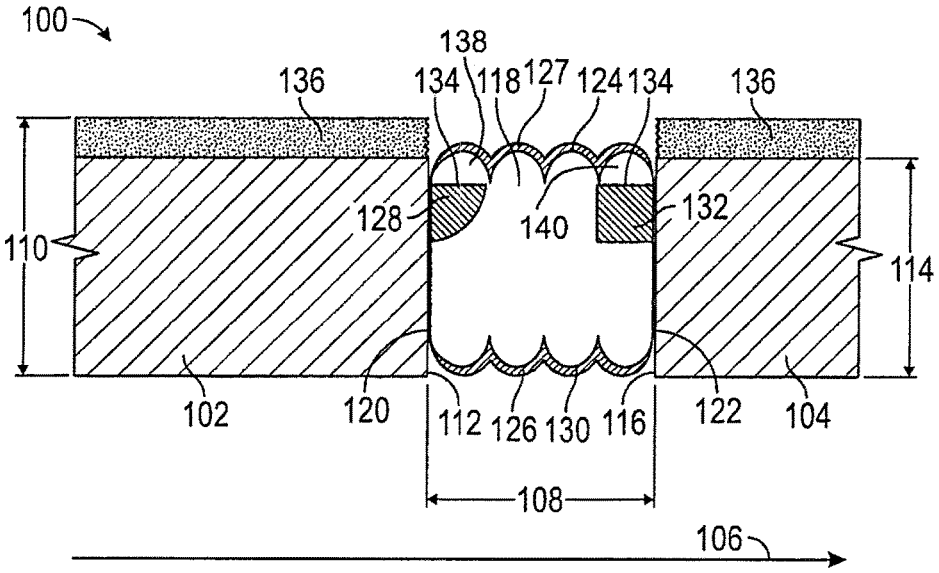
FIG. 5 is an illustration of a side view of an expansion joint system of the present disclosure installed between two substrates at an alternative location well below the top of the adjacent substrates.

The expansion joint system 100 of the present disclosure includes a body of compressible foam 118, at least one intumescent member 128, and may include at least one elastomer layer 127 which provide an integral, but flexible, expansion joint system which has reduced susceptibility to shearing and delamination while providing fire-protection to substrate upper portions, edges and adjacent surfaces. Referring to FIGS. 1-3 and 5, the expansion joint system 100 is illustrated when imposed under compression between a first substrate 102 and a second substrate 104, typically occurring at a joint 103 between two substrates 102, 104. A side view of the expansion joint system of the present disclosure when installed between two substrates to extend above the top of the adjacent substrates is illustrated in FIG. 1. A side view of an expansion joint system of the present disclosure when installed between two substrates at an alternative location well below the top of the adjacent substrates is illustrated in FIG. 5. Substrates 102 and 104 are typically concrete. As with most construction surface, such as roadways, walls, and, in the case of tunnels, ceilings, the first substrate 102 and the second substrate 104 are generally co-planar to a first plane 106, i.e. at least substantially but not necessarily precisely co-planar. To avoid fracture during expansion, such as during summer heating, the substrates 102, 104, are separated, such as by a first distance 108. To prevent contaminants and water from entering the gap between the substrates 102, 104, the expansion joint system is imposed between the substrates 102, 104. The first substrate 102 has a first substrate thickness 110, and has a first substrate end face 112 generally perpendicular to the first plane 106, i.e. at least substantially but not necessarily precisely perpendicular. Likewise, the second substrate 104 has a second substrate thickness 114 and has a second substrate end face 116 generally perpendicular to the first plane, forming an exposed vertical surface, i.e. at least substantially but not necessarily precisely perpendicular. Using a compressible foam ensures the expansion joint system provides a sufficient seal to the two substrates 102, 104 to prevent contaminates, or freezing water, was accumulating between the two substrates 102, 104. The compressible foam is sized to be compressible to a width less than the first distance 108, i.e. sufficiently compressible to be wedged into the gap between the two substrates 102, 104, but being larger than the first distance 108, i.e. so that the expansion joint system 100 maintains force against, and therefore provides the seal to the two substrates 102, 104. The compressible foam has a sufficient body thickness 204 to provide the sufficient seal to the two substrates 102, 104

The body of compressible foam 118 of the expansion joint system 100 is fire retardant to reduce the likelihood of damage from a fire atop the first substrate 102 or the second substrate 104, and has a body first face 120, a body first fact segment 138 proximate the body first face 120, a body second face 122 opposite the body first face 120, a body second fact segment 140 proximate the body second fact 122, a body top 124, a body bottom 126 opposite the body top 124, a body width 202, a body thickness 204, a body length 206, and a first body channel **208*a*. The body first face 120 contacts the first substrate end face 112 when imposed under compression between the first substrate 102 and the second substrate 104, and may include an adhesive on one or both of its faces to ensure seal operation. Likewise, the body second face 122 contacts the second substrate end face 116 when imposed under compression between the first substrate 102 and the second substrate 104, and may include an adhesive on its face to ensure seal operation. The body of compressible foam 118 includes a body width 202 extending from the body first face 120 to the body second face 122 and has a body width 202 greater than the first distance 108 to ensure fit of the body of compressible foam 118 into the gap between the first substrate 102 and the second substrate 104. The body of compressible foam 118 includes a body thickness 204 extending from the body top 124 to the body bottom 126, where the body thickness 204 is equivalent to one of the first substrate thickness 110 and the second substrate thickness 114, but preferably not substantially greater than either. In one embodiment, the body of compressible foam 118 further includes a first body channel 208*a* in the body first face 120 proximate the body top 124 along the body length 206. The first body channel 208*a* in the body first face 120 is sufficiently near the body top 124 to permit activation of the first intumescent 128 to readily protect the adjacent substrate 102, 104 from fire damage. The first body channel 208*a* may be adjacent, near to, or proximate the body top 124, but is not, at its lowest portion, at or above the body top 124. So that the first intumescent member 128 does not substantially affect the flexibility of the body of compressible foam 118, the first body channel 208*a* is preferably no wider than 25% of the body width 202 and is preferably no taller than 25% of the body thickness 204. The first body channel 208*a* is found in the top third of the body thickness 204, preferably at the body first face 120 below the body first face segment 138 along the body length 206, and extends from the body first face 120 not more than one quarter of the distance from the body first face 120 to the body second face 122**.

Figure 3:
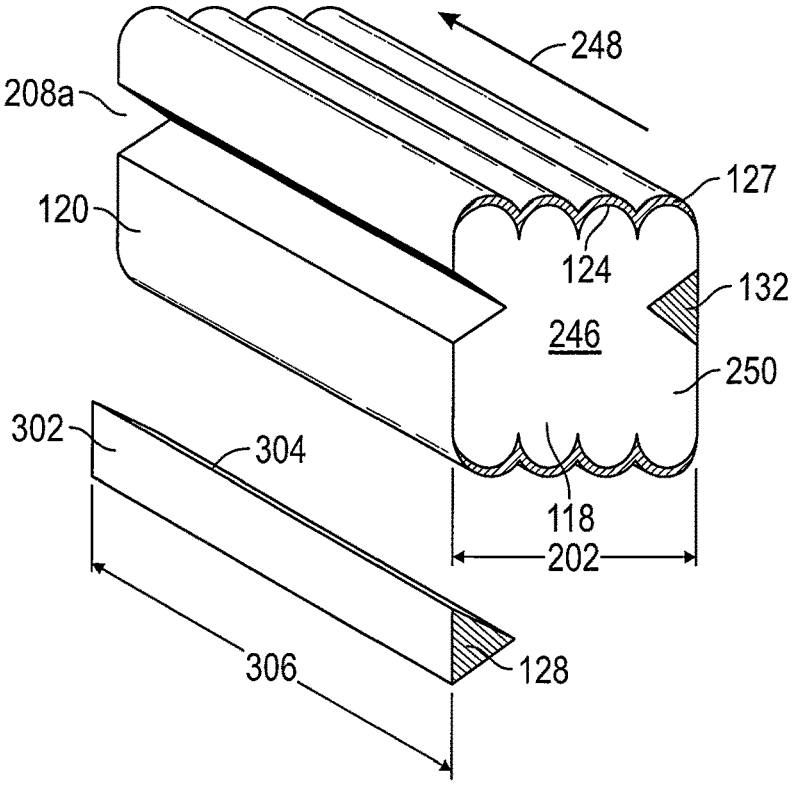
FIG. 3 is an illustration of an isometric view of the expansion joint system of the present disclosure from a different view.

In this embodiment, the first intumescent member 128 is bonded to, such as by adhesion, the body of compressible foam 118 so as to maintain position during installation and during flexing of the body of compressible foam 118 during substrate contraction and expansion. Referring now to FIG. 3, the first intumescent member 128 has a first intumescent member first outer surface 302, a first intumescent member second outer surface 304, and a first intumescent member length 306. The first intumescent member first outer surface 302 is generally flat, i.e. at least substantially but not necessarily precisely flat, but the first intumescent member second outer surface 304 may be flat, or curved, or polygonal, such as a triangle, so that the first intumescent member 128 may have a semicircle, a quarter-round, a rectangular, or even a triangular profile, preferably where any top flat surface 134 is parallel to the first plane 106. The first intumescent member 128 is adhered to the body of compressible foam 118 at this first intumescent member second outer surface 304 and is the positioned in the first body channel 208*a* so that the first intumescent member first outer surface 302 is generally aligned with the body first face 120, i.e. at least substantially but not necessarily precisely aligned. Thus, the first body channel 208*a* is entirely filled with the first intumescent member 128. Likewise, the first intumescent member length 306 is equivalent to, and aligned with, the body length 206.

Figure 6:
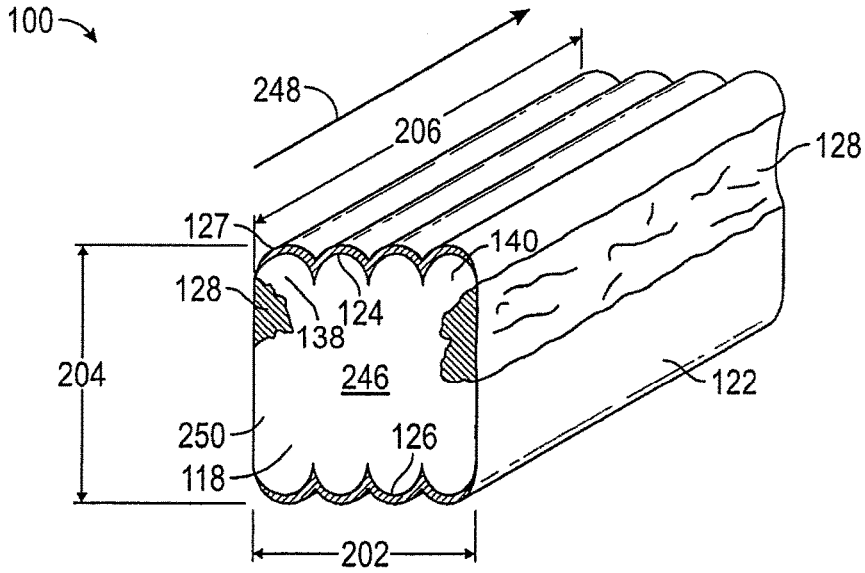
FIG. 6 is an illustration of an alternative embodiment where the first intumescent member is formed by force injection of a then-liquid containing intumescent.

In an alternative embodiment, illustrated in FIG. 6, the first intumescent member 128 is formed by force injection of a then-liquid containing intumescent into the body of compressible foam 118 in the body first face 120 below the body first face segment 138 or in the top third of the body thickness 204, and along the body length 206, and extends into the body of compressible foam 118 from the body first face 120 toward the body second face 122 not more than one quarter of the distance from the body first face 120.

In the various embodiments, the body first face segment 138 may be sized for positioning entirely above the first substrate 102, thus positioning the first intumescent member 128 proximate, and preferably so that its top is equal to, the top of the first substrate 102. As a result, when exposed to heat, the first intumescent member 128 expands to fit about the exposed portion of the first substrate 102, whether that is simply the exposed first substrate end face 112 or includes some portion of the top of the first substrate 102 due to degradation of the cementious fireproofing 136.

Alternatively, the body first face segment 138 may be sized for positioning the first intumescent member 128 below the top of the first substrate 102, as illustrated in FIG. 1, reducing the exposure of the expansion joint system 100 to wear and tear. As a result, when exposed to heat, the first intumescent member 128 still expands to fit about the exposed portion of the first substrate 102, but is subject to limited, or no, expansion to protect the top of the first substrate 102 due to degradation of the cementious fireproofing 136.

Figure 4:
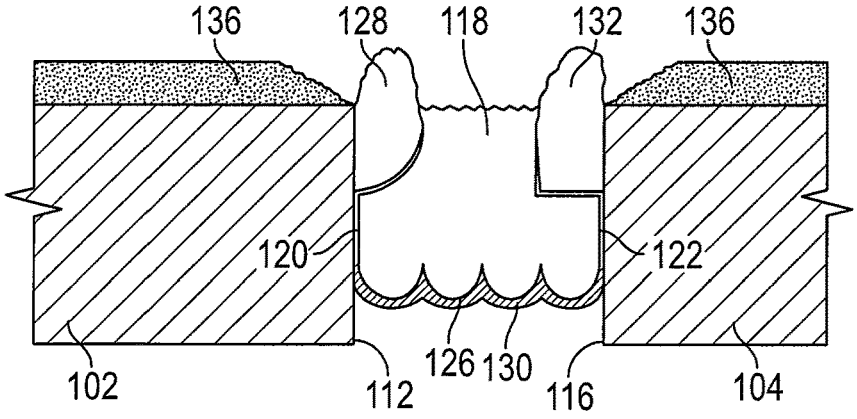
FIG. 4 is an illustration of a side view of the expansion joint system of the present disclosure installed between two substrates after exposure to high temperature.

Referring to FIG. 4, in operation, when the expansion joint system 100 has been compressed, imposed between the two substrates 102, 104, and permitted to expand, and exposed to fire or high heat, the expansion joint system 100 provides a first intumescent member 128 which contacts and protects the exposed first substrate end face 112. The top of the first substrate 102 may be covered with a cementious fireproofing 136, but this fireproofing does not extend past the first substrate end face 112 lest it interfere with the sealing function of the expansion joint system 100. Alternatively, the top of the first substrate may be covered with a solid board for the same purpose. Similarly, the expansion joint system 100 preferably does not extend substantially above the first substrate 102 or the second substrate 104, such as beyond the top of the cementious fireproofing 136 at all, or to such an extent as to preclude the waterproofing benefit of the first elastomer layer 127, lest the expansion joint system 100 interfere with the cementious fireproofing or permit water penetration in the joint. Additionally, the expansion joint system 100, when installed, does not bond to or apply pressure to the cementious fireproofing 136. As a result, the first substrate first end face 112 is preferably exposed at its uppermost portion nearest the corner, though it may be fully contacted by the expansion joint system 100 as provided previously. In the event of heating above standard operation range, the first intumescent member 128 is activated, and expands to protect the first substrate first end face 112, an exposed vertical surface, as illustrated in FIG. 4. When the first intumescent member 128 is positioned proximate the top of the first substrate 102, the first intumescent member 128, while expanding, will expand past the top of the first substrate 102, fully protecting the exposed corner and potentially expanding to cover any area exposed by loss of the cementious fireproofing 136. In an alternative embodiment, illustrated in FIG. 7, and the expansion joint system of the present disclosure may be installed between two substrates well below the top of the adjacent substrates.

The expansion joint system 100 may be made water-resistant by imposition of a first elastomer layer 127, which may be silicone, adhered to the body of compressible foam 118 at the body top 124 and extending from the body first face 120 to the body second face 122, wherein the first elastomer layer provides a water-resistant top layer. A second elastomer layer 130, which may be silicone, may be adhered to the body of compressible foam 118 at the body bottom 126 and extending from the body first face 120 to the body second face 122. To facilitate an increased surface area for bonding of the first elastomer layer 127 and the second elastomer layer 130 to the body of compressible foam 118, and particularly to ensure that the first elastomer layer 127 and the second elastomer layer 130 extend from the first substrate end face 112 of first substrate 102 to the second substrate end face 116 of the second substrate 104 at all points between expansion and compression of the two substrates 102, 104, altering the distance 108 between them, the body top 124 and the body bottom 126 may have profiles which likewise provide for expansion and compression, like an accordion, which may be formed of sequential semicircular like shapes or which may be triangular in appearance, such that the first elastomer layer 127 and the second elastomer layer 130 have an overall distance greater than the first distance 108.

Figure 2:
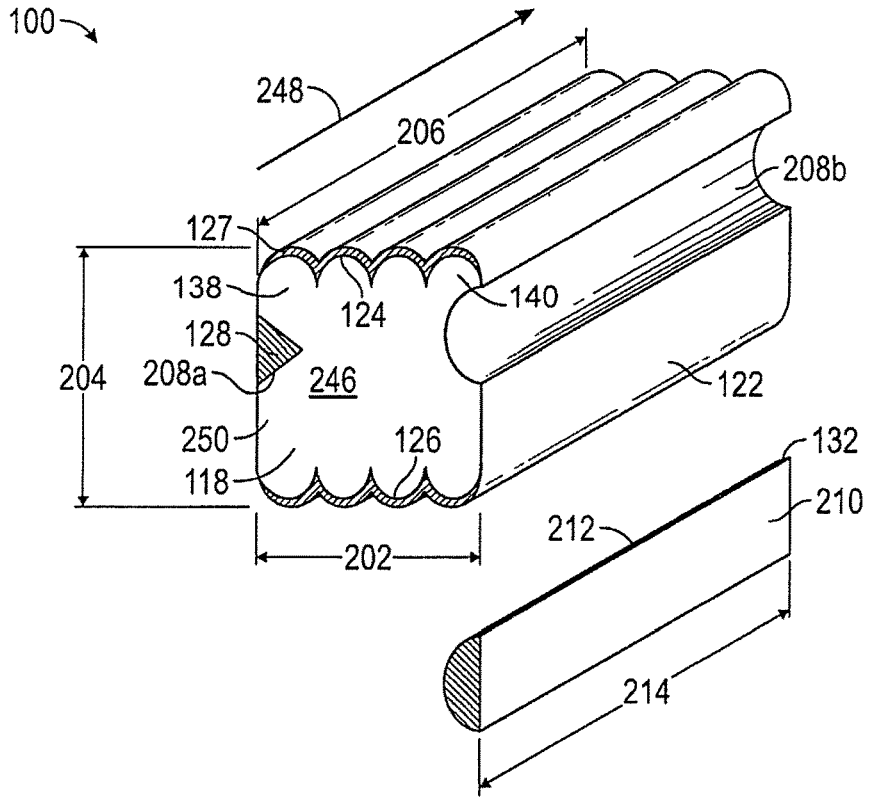
FIG. 2 is an illustration of an isometric view of the expansion joint system of the present disclosure.

Referring now to FIG. 2, to also protect the second substrate 104, the expansion joint system 100 may include a second body channel 208*b* and a second intumescent member 132, which performs in the same manner as the first intumescent member 128. Where utilized, a second body channel 208*b* is provided in the body of compressible foam 118 in the body second face 122 proximate, adjacent, or near the body top 124 along the body length 206. The second intumescent member 132, having a second intumescent member first outer surface 210, a second intumescent member second outer surface 212, and a second intumescent member length 214, is adhered to the body of compressible foam 118 at the second intumescent member second outer surface 212 in the second body channel 208. The second intumescent member first outer surface 210 generally aligned with the body second face 122, i.e. at least substantially but not necessarily precisely aligned. The second intumescent member length 214 equivalent to, and positioned consistent with, the body length 206, so as to provide a unitary whole. The second body channel 208*b* may be adjacent, near to, or proximate the body top 124, but is not at or above the body top 124. So that the second intumescent member 132 does not substantially affect the flexibility of the body of compressible foam 118, the second body channel 208*b* is preferably no wider than one quarter of the body width 202 and is preferably no taller than one quarter of the body thickness 204.

Similarly, in an alternative embodiment, a second intumescent member 132 is provided and formed by force injection of a then-liquid containing intumescent into the body of compressible foam 118 in the body second face 122 below the body second face segment 140 and along the body length 206 or in the top third of the body thickness 204, and extends from the body second face 122 not more than one quarter of the distance from the body first face 120 to the body second face 122.

In a further embodiment, the expansion joint system 100 may be a seismic expansion joint system which, by virtue of the aforementioned structure, includes two intumescent segments 128, 132 strategically integrated in a highly-resilient compressible foam 118 to protect the uncoated edge of the adjacent substrates 102, 104. The fire-rated compressed expansion joint sealant system 100 is provided with an intumescent 128, 132 proximate, but below the water-resistant top layer 127 of the fire retardant foam 118, so that if the joint 103 is exposed to fire, the intumescent 128, 132 will expand, protecting the exposed vertical surface 112, 116 of the adjacent substrate 102, 104. Positioning of intumescent 128, 132 in body channels 208*a*, 208*b* in the fire retardant foam 118 adjacent, near to, or proximate the body top 124, but not at or above the body top 124, provides a common flat provide at the body face 120, 122 prior to installation, provides for protection of the substrate 102, 104 while not reducing the operable movement range of the fire retardant foam 118 of the expansion joint seal 100. The end of the substrates 102, 104, which may be concrete, is therefore protected in a system which does not require joint overlap between the horizontal fire resistant coating 128, 132, and the compressible sealant 127, allowing for a greater range of use that is current provided by intumescent sealants, that are known in the art to have limited capacity and cycling. Therefore each expansion joint sealant system 100 may include a body end face 246 having single plane profile 250, which may be perpendicular to the plane 248 associated with the length 214 of the expansion joint sealant system 100 or which may be at an angle to that length 206, thus providing a flat face for abutment of an additional adjacent expansion joint sealant system 100.

Figure 7:
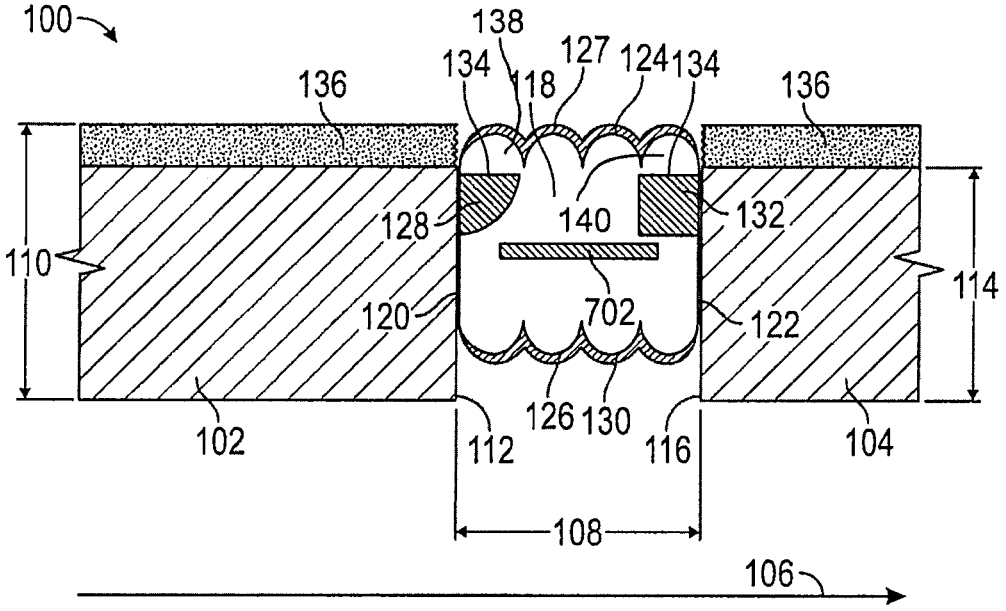
FIG. 7 is an illustration of an alternative embodiment further containing an intumescent barrier.

In a further embodiment, illustrated in FIG. 7, the seismic expansion joint system 100 further comprises a flexible, expanding, intumescent membrane 702 which extends laterally, preferably generally parallel to the first plane 106, from near the body first face 120 to near the body second face 122, thus maintaining the integrity of the foam 118, and a position sufficiently below the bottom of at least one intumescent member 128 and/or the second at least one intumescent member 132 to force each upward while seeking to maintain the integrity of the foam 118. The flexible, expanding, intumescent membrane 702 is positioned within the body of compressible foam 118, aligned laterally with the first plane 106, and extends from a position adjacent the body first face 120 to a position adjacent the body second face 122. The membrane 702 is therefore positioned below a bottom of the first intumescent member 128 and the second intumescent member 132. In operation, when exposed to heat, the intumescent membrane 702 expands and drives the portion of the seismic expansion joint system 100 containing the at least one intumescent member 128 and/or the second at least one intumescent member 132 toward the heat source, speeding the protection provided by a seismic expansion joint system 100, wherein the the at least one intumescent member 128 and/or the second at least one intumescent member 132 will expand to overlap and protect the front edges of the first and second joint substrates 102, 104, such as from heat spalling where the first and second joint substrates 102, 104 are composed of concrete. This expansion may be accomplished in a period of about ten (10) seconds, or in a relatively short period of time sufficient to limit substrate damage in response to increased temperatures, which may be less than or greater than ten (10) seconds, including potentially a matter of only a few seconds or in time frames measured in a minute or more.

Referring to FIG. 8, the seismic expansion joint system 100 may further comprise a third intumescent member 802 with a third intumescent member first outer surface 804 wherein the third intumescent member 802 is made integral to the body of compressible foam 118 such that the third intumescent member first outer surface 804 is substantially aligned with the body top 124 or wherein the third intumescent member 802 is adhered to the body of compressible foam 118 on the body top 124. The third intumescent member 802 may have a third intumescent member length 806 equivalent to the body length 206. The intumescent member 802 may be positioned at any location on the body top 124, such as in the center or at one-third the body width 202. Additionally, a fourth intumescent member 808 may be provided, such that the fourth intumescent member 808 has a fourth intumescent member first outer surface 810 wherein the fourth intumescent member 808 is made integral to the body of compressible foam 118 such that the fourth intumescent member first outer surface 810 is substantially aligned with the body top 124 or wherein the fourth intumescent member 808 is adhered to the body of compressible foam 118 on the body top 124 The fourth intumescent member 808 may have a fourth intumescent member length 812 equivalent to the body length 206.

When configured as a seismic expansion joint, the expansion joint system 100 is capable, due to material selection, of movement of nearly ±50% of width, and simultaneously meets Class II and III cycling per ASTM International standard E-1399-97 (2013), entitled "Standard Test Method for Cyclic Movement and Measuring the Minimum and Maximum Joint Widths of Architectural Joint Systems." A seismic expansion joint having such flexibility while simultaneously providing for protection of adjacent substrate in the event of fire is unknown.

The present disclosure thus provides for focused substrate protection in a precise and predictable way without limiting the water-resistant function of the joint during its lifespan. Further, by using this intumescent 128, 132 located as drawn or slightly inset under the surface of the foam 118 has proven to reduce the amount of fire retardant components required to pass certain fire ratings, such as UL 2079, entitled Tests for Fire Resistance of Building Joint Systems (as revised Mar. 19, 2006). With the substrate protecting intumescent 128, 132, the present disclosure allows for a lower compression density of the fire-retardant compressible foam, such as in the range of between 70-300 kg/m$^3$ which allows for a higher movement range. Surprisingly, even higher compression and densities ranges have been found to work well within standard cycling regimes such that they still meet seismic classifications per ASTM E-1399-97 (2000) while still meeting the current TT endurance of the RWS curve. To further promote the operation of the expansion joint system as both a seal against foreign contaminants and a protection of the substrate faces, the body of compressible foam 118 may be an open-celled foam infused with a fire retardant, may be an open-celled foam composed of a fire retardant material, or may be a closed-cell foam composed of a fire retardant material.

The selection of components providing resiliency, compressibility, water-resistance and fire resistance, the expansion joint system 100 may be constructed to provide sufficient characteristics to obtain fire certification under any of the many standards available. In the United States, these include ASTM International's E 814 and its parallel Underwriter Laboratories UL 1479 "Fire Tests of Through-penetration Firestops," ASTM International's E1966 and its parallel Underwriter Laboratories UL 2079 "Tests for Fire-Resistance Joint Systems," ASTM International's E 2307 "Standard Test Method for Determining Fire Resistance of Perimeter Fire Barrier Systems Using Intermediate-Scale, Multi-story Test Apparatus, the tests known as ASTM E 84, UL 723 and NFPA 255 "Surface Burning Characteristics of Building Materials," ASTM E 90 "Standard Practice for Use of Sealants in Acoustical Applications," ASTM E 119 and its parallel UL 263 "Fire Tests of Building Construction and Materials," ASTM E 136 "Behavior of Materials in a Vertical Tube Furnace at 750° C." (Combustibility), ASTM E 1399 "Tests for Cyclic Movement of Joints," ASTM E 595 "Tests for Outgassing in a Vacuum Environment," ASTM G 21 "Determining Resistance of Synthetic Polymeric Materials to Fungi." Some of these test standards are used in particular applications where firestop is to be installed.

Most of these use the Cellulosic time/temperature curve, described by the known equation T=20+345*LOG(8*t+1) where t is time, in minutes, and T is temperature in degrees Celsius including E 814/UL 1479 and E 1966/UL 2079.

E 814/UL 1479 tests a fire-retardant system for fire exposure, temperature change, and resilience and structural integrity after fire exposure (the latter is generally identified as "the Hose Stream test"). Fire exposure, resulting in an F [Time] rating, identifies the time duration—rounded down to the last completed hour, along the Cellulosic curve before flame penetrates through the body of the system, provided the system also passes the hose stream test. Common F ratings include 1, 2, 3 and 4 hours Temperature change, resulting in a T [Time] rating, identifies the time for the temperature of the unexposed surface of the system, or any penetrating object, to rise 181° C. above its initial temperature, as measured at the beginning of the test. The rating is intended to represent how long it will take before a combustible item on the non-fireside will catch on fire from heat transfer. In order for a system to obtain a UL 1479 listing, it must pass both the fire endurance (F rating) and the Hose Stream test. The temperature data is only relevant where building codes require the T to equal the F-rating. In the present expansion joint system 100, the bottom surface temperature of a bottom of the body of compressible foam 118 at a maximum joint width increases no more than 181° C. after sixty minutes when the expansion joint seal 100 is exposed to heating according to the equation T=20+345*LOG(8*t+1), where t is time in minutes and T is temperature in C. Further, where the body of compressible foam 118 has a maximum joint width of more than six (6) inches, the bottom surface temperature of a bottom of the body of compressible foam increases no more than 139° C. after sixty minutes when the expansion joint seal 100 is exposed to heating according to the equation T=20+345*LOG(8*t+1), where t is time in minutes and T is temperature in C.

When required, the Hose Steam test is performed after the fire exposure test is completed. In some tests, such as UL 2079, the Hose Stream test is required with wall-to-wall and head-of-wall joints, but not others. This test assesses structural stability following fire exposure as fire exposure may affect air pressure and debris striking the fire-resistant system. The Hose Stream uses a stream of water. The stream is to be delivered through a 64 mm hose and discharged through a National Standard playpipe of corresponding size equipped with a 29 mm discharge tip of the standard-taper, smooth-bore pattern without a shoulder at the orifice consistent with a fixed set of requirements:

| Hourly Fire Rating Time in Minutes | Water Pressure (kPa) | Duration of Hose Stream Test (sec./m$^2$) |
|---|---|---|
| 240 ≤ time < 480 | 310 | 32 |
| 120 ≤ time < 240 | 210 | 16 |
| 90 ≤ time < 120 | 210 | 9.7 |
| time <90 | 210 | 6.5 |

The nozzle orifice is to be 6.1 m from the center of the exposed surface of the joint system if the nozzle is so located that, when directed at the center, its axis is normal to the surface of the joint system. If the nozzle is unable to be so located, it shall be on a line deviating not more than 30° from the line normal to the center of the joint system. When so located its distance from the center of the joint system is to be less than 6.1 m by an amount equal to 305 mm for each 10° of deviation from the normal. Some test systems, including UL 1479 and UL 2079 also provide for air leakage and water leakage tests, where the rating is made in conjunction with a L and W standard. These further ratings, while optional, are intended to better identify the performance of the system under fire conditions.

When desired, the Air Leakage Test, which produces an L rating and which represents the measure of air leakage through a system prior to fire endurance testing, may be conducted. The L rating is not pass/fail, but rather merely a system property. For Leakage Rating test, air movement through the system at ambient temperature is measured. A second measurement is made after the air temperature in the chamber is increased so that it reaches 177° C. within 15 minutes and 204° C. within 30 minutes. When stabilized at the prescribed air temperature of 204±5° C., the air flow through the air flow metering system and the test pressure difference are to be measured and recorded. The barometric pressure, temperature and relative humidity of the supply air are also measured and recorded. The air supply flow values are corrected to standard temperature and pressure (STP) conditions for calculation and reporting purposes. The air leakage through the joint system at each temperature exposure is then expressed as the difference between the total metered air flow and the extraneous chamber leakage. The air leakage rate through the joint system is the quotient of the air leakage divided by the overall length of the joint system in the test assembly and is less than 0.005 L/s■m$^2$ at 75 Pa or equivalent air flow extraneous, ambient and elevated temperature leakage tests.

When desired, the Water Leakage Test produces a W pass-fail rating and which represents an assessment of the watertightness of the system, can be conducted. The test chamber for or the test consists of a well-sealed vessel sufficient to maintain pressure with one open side against which the system is sealed and wherein water can be placed in the container. Since the system will be placed in the test container, its width must be equal to or greater than the exposed length of the system. For the test, the test fixture is within a range of 10 to 32° C. and chamber is sealed to the test sample. Non-hardening mastic compounds, pressure-sensitive tape or rubber gaskets with clamping devices may be used to seal the water leakage test chamber to the test assembly. Thereafter, water, with a permanent dye, is placed in the water leakage test chamber sufficient to cover the systems to a minimum depth of 152 mm. The top of the joint system is sealed by whatever means necessary when the top of the joint system is immersed under water and to prevent passage of water into the joint system. The minimum pressure within the water leakage test chamber shall be 1.3 psi applied for a minimum of 72 hours. The pressure head is measured at the horizontal plane at the top of the water seal. When the test method requires a pressure head greater than that provided by the water inside the water leakage test chamber, the water leakage test chamber is pressurized using pneumatic or hydrostatic pressure. Below the system, a white indicating medium is placed immediately below the system. The leakage of water through the system is denoted by the presence of water or dye on the indicating media or on the underside of the test sample. The system passes if the dyed water does not contact the white medium or the underside of the system during the 72 hour assessment.

Another frequently encountered classification is ASTM E-84 (also found as UL 723 and NFPA 255), Surface Burning Characteristics of Burning Materials. A surface burn test identifies the flame spread and smoke development within the classification system. The lower a rating classification, the better fire protection afforded by the system. These classifications are determined as follows:

| Classification | Flame Spread | Smoke Development |
|---|---|---|
| A | 0-25 | 0-450 |
| B | 26-75 | 0-450 |
| C | 76-200 | 0-450 |

UL 2079, Tests for Fire Resistant of Building Joint Systems, comprises a series of tests for assessment for fire resistive building joint system that do not contain other unprotected openings, such as windows and incorporates four different cycling test standards, a fire endurance test for the system, the Hose Stream test for certain systems and the optional air leakage and water leakage tests. This standard is used to evaluate floor-to-floor, floor-to-wall, wall-to-wall and top-of-wall (head-of-wall) joints for fire-rated construction. As with ASTM E-814, UL 2079 and E-1966 provide, in connection with the fire endurance tests, use of the Cellulosic Curve. UL 2079/E-1966 provides for a rating to the assembly, rather than the convention F and T ratings. Before being subject to the Fire Endurance Test, the same as provided above, the system is subjected to its intended range of movement, which may be none. These classifications are:

| Movement Classification (if used) | Minimum number of cycles | Minimum cycling rate (cycles per minute) | Joint Type (if used) |
|---|---|---|---|
| No Classification | 0 | 0 | Static |
| Class I | 500 | 1 | Thermal Expansion/Contraction |
| Class II | 500 | 10 | Wind Sway |
| Class III | 100 | 30 | Seismic |
| | 400 | 10 | Combination |

Preferably, the expansion joint system 100 can be cycled at least one of more of 500 times at 1 cycle per minute, 500 times at 10 cycles per minute and 100 cycles at 30 times per minute, without indication of stress, deformation or fatigue.

ASTM E 2307, Standard Test Method for Determining Fire Resistance of Perimeter Fire Barrier Systems Using Intermediate-Scale, Multi-story Test Apparatus, is intended to test for a systems ability to impede vertical spread of fire from a floor of origin to that above through the perimeter joint, the joint installed between the exterior wall assembly and the floor assembly. A two-story test structure is used wherein the perimeter joint and wall assembly are exposed to an interior compartment fire and a flame plume from an exterior burner. Test results are generated in F-rating and T-rating. Cycling of the joint may be tested prior to the fire endurance test and an Air Leakage test may also be incorporated.

The foregoing disclosure and description is illustrative and explanatory thereof. Various changes in the details of the illustrated construction may be made within the scope of the appended claims without departing from the spirit of the invention. The present invention should only be limited by the following claims and their legal equivalents.

What is claimed is:

1. An expansion joint seal system for imposition between a first substrate and a second substrate, comprising, a body of compressible foam, the body of compressible foam being fire retardant, the body of compressible foam having a body first face intermediate a body top and a body bottom and a body second face opposite the body first face, wherein the body first face is adapted to contact the first substrate end face and the body second face is adapted to contact the second substrate end face, a first intumescent member, the first intumescent member having a first intumescent member first outer surface, the first intumescent member made integral to the body of compressible foam, the first intumescent member first outer surface substantially aligned with the body first face, a second intumescent member, the second intumescent member having a second intumescent member first outer surface, the second intumescent member made integral to the body of compressible foam, the second intumescent member first outer surface substantially aligned with the body second face, and wherein a bottom surface temperature of a bottom of the body of compressible foam at a maximum joint width increases no more than 181° C. after sixty minutes when the joint seal is exposed to heating according to the equation T=20+345*LOG(8*t+1), where t is time in minutes and T is temperature in C.

2. The expansion joint seal system of claim 1, wherein the body of compressible foam has a body length, and the first intumescent member and the second intumescent member have an intumescent member length equivalent to the body length.

3. The joint seal of claim 1, wherein the joint seal is adapted to be cycled one of 500 times at 1 cycle per minute, 500 times at 10 cycles per minute and 100 cycles at 30 times per minute, without indication of stress, deformation or fatigue.

4. The expansion joint seal system of claim 2, wherein the body of compressible foam further comprises a first body channel, the first body channel in the body of compressible foam below a body first face segment in the body first face along a body length and a second body channel, the second body channel in the body of compressible foam below a body second face segment in the body second face along a body length, and wherein the first intumescent member is adhered to the body of compressible foam at a first intumescent member second outer surface in the first body channel and the second intumescent member is adhered to the body of compressible foam at a second intumescent member second outer surface in the second body channel.

5. The expansion joint system of claim 4, wherein the first intumescent member has a quarter-circle profile and a top surface parallel to the body top and the second intumescent member has a quarter-circle profile and a top surface parallel to the body top.

6. The expansion joint system of claim 1, wherein the first intumescent member is force injected into the body of compressible foam in the body first face below a body first face segment along the body length and the second intumescent member is force injected into the body of compressible foam in the body second face below a body second face segment along the body length.

7. The expansion joint system of claim 1, further comprising:

a flexible, expanding, intumescent membrane positioned within the body of compressible foam extending from a position adjacent the body first face to a position adjacent the body second face, the membrane positioned below a bottom of the first intumescent member and a bottom of the second intumescent member.

8. The joint seal of claim 1, wherein the body of compressible foam having a maximum joint width of more than six (6) inches and a bottom surface temperature of a bottom of the body of compressible foam increases no more than 139° C. after sixty minutes when the joint seal is exposed to heating according to the equation T=20+345*LOG(8*t+1), where t is time in minutes and T is temperature in C.

* * * * *